US006515676B1

(12) United States Patent
Kasai et al.

(10) Patent No.: US 6,515,676 B1
(45) Date of Patent: Feb. 4, 2003

(54) ANALOG INTERFACE DISPLAY APPARATUS WITH COLOR DISPLAY CONTROL

(75) Inventors: Naruhiko Kasai, Yokohama (JP); Tsutomu Furuhashi, Yokohama (JP); Hiroshi Kurihara, Mobara (JP); Nobutaka Kato, Owariasahi (JP); Masashi Mori, Chigasaki (JP); Yukio Hiruta, Fujisawa (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/603,967

(22) Filed: Jun. 26, 2000

Related U.S. Application Data

(62) Division of application No. 08/837,822, filed on Apr. 22, 1997, now Pat. No. 6,151,007.

(30) Foreign Application Priority Data

Apr. 23, 1996 (JP) ..... 8-100880
Sep. 17, 1996 (JP) ..... 8-267884

(51) Int. Cl.[7] ..... G09G 3/36; G09G 5/00
(52) U.S. Cl. ..... 345/629; 345/95; 345/629
(58) Field of Search ..... 345/629, 87, 90, 345/89, 691, 95, 100, 113, 114, 116, 523; 348/501; 341/132, 134

(56) References Cited

U.S. PATENT DOCUMENTS 5,027,117 A 6/1991 Yoshida et al. ..... 341/132
5,028,914 A 7/1991 Povenmire ..... 345/440.1
5,061,920 A 10/1991 Nelson ..... 345/89
5,210,538 A 5/1993 Kuroiwa ..... 280/288.1
5,298,912 A 3/1994 Mano et al. ..... 345/88
5,449,327 A * 9/1995 Satoh Heddon et al. .... 345/634
5,696,527 A * 12/1997 King et al. ..... 345/629
5,786,846 A * 7/1998 Hiraoki ..... 348/20
5,819,741 A * 10/1998 Karlsson et al. ..... 128/710
5,838,336 A * 11/1998 Ross ..... 345/629
5,877,819 A * 3/1999 Branson ..... 348/701
5,883,610 A * 3/1999 Jeon ..... 345/629
5,961,569 A * 10/1999 Craport et al. ..... 701/200

FOREIGN PATENT DOCUMENTS

DE 43 07 366 A1 9/1994
EP 0 348 123 12/1989
JP 2-245793 10/1990

* cited by examiner

*Primary Examiner*—Jeffery Brier
*Assistant Examiner*—Anthony J. Blackman
(74) *Attorney, Agent, or Firm*—Antonelli, Terry, Stout & Kraus, LLP

(57) ABSTRACT

In a liquid crystal display apparatus having a liquid crystal display panel, an input analog display data is converted to a digital display data, a data portion is selected from the digital display data, and display status information is displayed on the display panel in the form of an overlay display data over the digital display data, so that display adjustment on the display panel is possible. The display adjustment may be automatically performed by use of a minimum value data and a maximum value data, found among the digital display data, for an automatic offset level adjustment and for an automatic gain level adjustment, respectively.

5 Claims, 22 Drawing Sheets

ANALOG INTERFACE DISPLAY APPARATUS WITH COLOR DISPLAY CONTROL

CROSS REFERENCE TO RELATED APPLICATION

This is a divisional of U.S. application Ser. No. 08/837,822, filed Apr. 22, 1997, now U.S. Pat. No. 6,151,007, the subject matter of which is incorporated by reference herein.

BACKGROUND OF THE INVENTION

The present invention relates to a liquid crystal display apparatus having an analog interface.

In a conventional liquid crystal display apparatus having an analog interface, for example, as described in the JP-A-2-245793 (Laid-Open Dec. 1, 1990), there are provided a liquid crystal panel including a liquid crystal display section, an analog-to-digital (A/D) converter circuit connected via an analog interface to an external device for converting input analog data having a plurality of signal levels into digital data, a voltage generator circuit for generating voltages having a plurality of levels according to gradation, a serial-to-parallel converter circuit for converting an input serial signal into a parallel signal, and latch means for simultaneously latching parallel outputs.

However, in the liquid crystal display apparatus of the conventional technology, since the digital data transformed from the analog data is invisible to the user, it is impossible, for example, to appropriately adjust the luminance, contrast, and color levels.

Additionally, in the apparatus of the article above, consideration has not been given to the setting of the reference voltage in the analog-to-digital conversion.

SUMMARY OF THE INVENTION

It is therefore an object of the present invention to provide a liquid crystal display apparatus in which the user can recognize the value of digital data converted from analog data and various adjustments such as the color level adjustment can be correctly accomplished.

Another object of the present invention is to provide a liquid crystal display apparatus in which the various adjustments such as the color level adjustment are automatically carried out using the values of digital data.

In some major aspects of the present invention, in a liquid crystal display apparatus having a liquid crystal display panel, an input analog display data is converted to a digital display data, a data portion is selected from the digital display data, and display status information is displayed on the display panel in the form of an overlay display data over the digital display data, so that display adjustment on the display panel is possible. The display adjustment may be automatically performed by use of a minimum value data and a maximum value data, found among the digital display data, for an automatic offset level adjustment and for an automatic gain level adjustment, respectively.

According to one aspect of the present invention, a liquid crystal display apparatus includes: a liquid crystal display section having a liquid crystal display panel; an A/D converting section for converting an input analog display data to a digital display data; means connected to the A/D converting section for selecting from the digital display data a data portion concerning a predetermined point on the display panel; a generator section connected to the selecting means for generating a display status indicator associated with the predetermined point on the display panel; and means connected to the A/D converting section and the generator section for producing a liquid crystal display data containing an overlay display data to be supplied to the liquid crystal display section, the overlay display data being a combination of the digital display data and the display status indicator.

According to another aspect of the present invention, a liquid crystal display appratus includes: a liquid crystal display section having a liquid crystal display panel; an A/D converting section for receiving an input analog display data and converting the input analog display data to a digital display data, the input analog display data having a black level and a brightest level, the A/D converting section including a black level controller for adjusting the black level of the input analog display data to generate a black level-adjusted analog display data and an A/D converter for converting the black level-adjusted analog display data to the digital display data using first reference level and a second reference level lower than the first reference level; a minimum value storing section connected to the A/D converter for storing a minimum value of the black level-adjusted analog display data; a maximum value storing section connected to the A/D converter for storing a maximum value of the black level-adjusted analog display data; an automatic offset adjusting section connected to the minimum value storing section for detecting a minimum value corresponding to the black level of the input analog display data and producing an adjusted offset level, the adjusted offset level being fed to the black level controller, whereby the black level of the input analog display data is shifted to the adjusted offset level, the adjusted offset level being such that a black level of the black level-adjusted analog display data is lower than the second reference level; and an automatic gain adjusting section connected to the maximum value storing section for detecting a maximum value corresponding to the brightest level of the input analog display data and producing an adjusted gain level, the adjusted gain level being fed as the first reference level to the A/D converter, whereby the first reference level for the A/D converter is changed to the adjusted gain level, the adjusted gain level being such that a brightest level of the input black level-adjusted analog display data is lower than the adjusted gain level, the digital display data from the A/D converting section being supplied to the liquid crystal display section panel.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Embodiment 1

Figure 1:
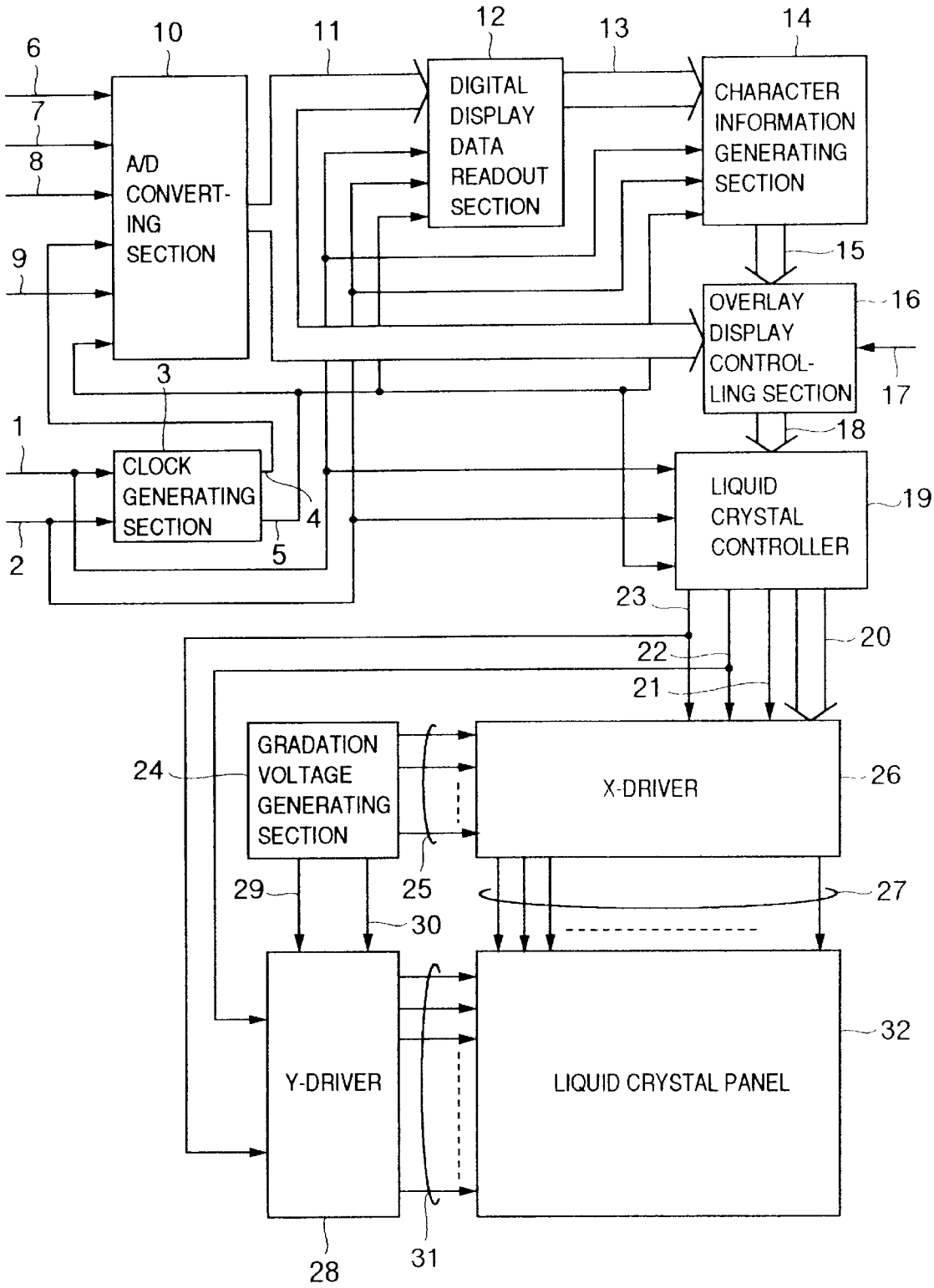
FIG. 1 is a block diagram showing an analog interface liquid crystal display apparatus in an embodiment according to the present invention.

FIG. 1 shows in a block diagram a simplified structure of an analog interfaced liquid crystal display apparatus in an embodiment according to the present invention.

In FIG. 1, reference numerals 1 and 2 indicate a vertical synchronization signal and a horizontal synchronization signal supplied from an analog interface of, for example, a personal computer, numeral 3 denotes a clock generating section, numeral 4 designates a black level adjustment timing signal, and numeral 5 stands for a dot clock. The clock generating section 3 includes a phase-locked loop (PLL) circuit and generates the dot clock 5 and the black level adjustment timing signal 4 to generate a pulse during a fly-back period of time, which will be described later. Reference numeral 6 indicates analog display data inputted from the analog interface, numeral 7 denotes an offset level for the black level adjustment of analog display data, numeral 8 represents a gain level as a high-level reference voltage for the analog-to-digital conversion (to be abbreviated as A/D conversion herebelow), numeral 9 designates a reference low level as a low-level reference voltage for the A/D conversion, numeral 10 stands for an A/D converting section, and numeral 11 indicates digital display data. The A/D converting section 10 converts the analog display data 6 the into digital display data 11 according to the offset level 7, gain level 8, black level adjustment timing signal 4, reference low level 9, and dot clock 5. In the following description, it is assumed that the A/D converting section 8 has a precision of three bits and. the digital display data 11 includes 3-bit data. Reference numeral 12 indicates a digital display data readout section and numeral 13 denotes readout data. The digital display data readout section 12 reads out the digital display data 11 at a particular display position (for example, selects a data portion related to a predetermined point on a liquid crystal panel 32, which will be described later) according to the dot clock 5, vertical synchronization signal 1, and horizontal synchronization signal 2 and then outputs the data 11 as readout data 13 (data portion 13). Reference numeral 14 designates a character information generating section and numeral 15 indicates readout data display information (display status indicator). To display on the display panel, which will be described later, the values of digital readout data 13 (values obtained as a result of the A/D conversion), the character information generating section 14 converts the readout data 13 into character information according to the dot clock 5 and vertical and horizontal synchronization signals 1 and 2 and then outputs the data 13 as readout data display information (conversion value information) 15. Reference numeral 16 represents an overlay display controlling section, numeral 17 indicates an A/D conversion value display control signal, which is disposed, for example, at an arbitrary position of the display apparatus and which is generated through an operation activated to display the conversion value information 15 for a color adjustment of the screen or the like, and numeral 18 designates overlay-controlled display data. The overlay display controlling section 16 achieves an operation responsive to the control signal 17 to achieved an overlay display of the readout data display information (conversion value information) on a screen in which the digital display data 11 is beforehand displayed so as to output overlay controlled display data (a combination of the digital display data 11 and the display status indicator 15). In this description, it is assumed that the A/D conversion value display control signal 17 is "1" when the digital data after the A/D conversion is to be displayed. Reference numeral 19 indicates a liquid crystal controller, numeral 20 denotes liquid crystal (LC) display data, numeral 21 represents a latch clock, numeral 22 designates a horizontal clock, and numeral 23 stands for a first line signal. The LC controller 19 re-arranges, as in the conventional technology, the overlay-controlled display data 18 in an array of pixels of the LC panel, which will be described later, to generate LC display data 20 in synchronism with the latch clock 21 generated according to the dot clock 5. Moreover, the LC controller 19 generates the horizontal clock as scan timing for each line and the first line signal 23 indicating the first position of one display period of time. Reference numeral 24 indicates a gradation voltage generating section, numeral 25 denotes a gradation voltage level signal, numeral 26 designates an X-driver to drive X signal lines, and numeral 27 stands for panel data. The X-driver 26 sequentially acquires, like in the case of prior art, one line of the LC display data 20 according to the latch clock 21, selects one of the gradation voltage level signals 25 generated from the gradation voltage generating section 24 according to data of each dot, and then outputs the data as panel data 27 in synchronism with a subsequent horizontal clock 22. In the description, it is assumed that the number of horizontal dots of the LC panel, which will be described later, is 640, the number of X signal lines is 1920 (=640×3 (one dot for red, green, and blue), and the gradation voltage level signals 25 have eighth levels. Reference numeral 28 indicates a Y-driver to drive Y-scan signal lines, numeral 29 designates a non-selection voltage signal, numeral 30 denotes a selection voltage signal, and numeral 31 stands for scan signal lines. The Y-driver 28 acquires the first line signal 23 and applies the selection voltage 30 to the first line of the group of scan signals lines 31 to thereby set the first signal line to the selection status. In synchronism with the horizontal clock 22 subsequent thereto, the scan signal lines 31 undergoes a shift operation such that the selection voltage 30 is sequentially applied to the second line, third line, etc. The non-selection voltage 29 is applied to the scan signal lines 31 other than those applied with the selection voltage signal 30. In this description, it is assumed that the number of vertical dots of the LC panel, which will be described later, is 480 and that of Y signal lines is 480. Reference numeral 32 indicates an LC panel, which displays thereon data on the scan signal lines 331 applied with the selection signal 30. In addition, as in the conventional case, the LC panel 32 includes a color filter for red (R), green (G), and blue (B) such that one dot includes three pixels to thereby achieve a color display through additive color mixture. As already described, it is assumed in this embodiment that the LC panel 32 has a resolution of 640×480 and eight gradation levels for each of red, green, and blue and can display 512 colors.

The matrix display panel 32 may display information in which each pixel includes N bits (N is a positive integer).

The gradation voltage generating section 24 desirably generates gradation voltage signals of 2N levels.

Furthermore, a color filter may be arranged on the matrix display panel 32.

Figure 2:
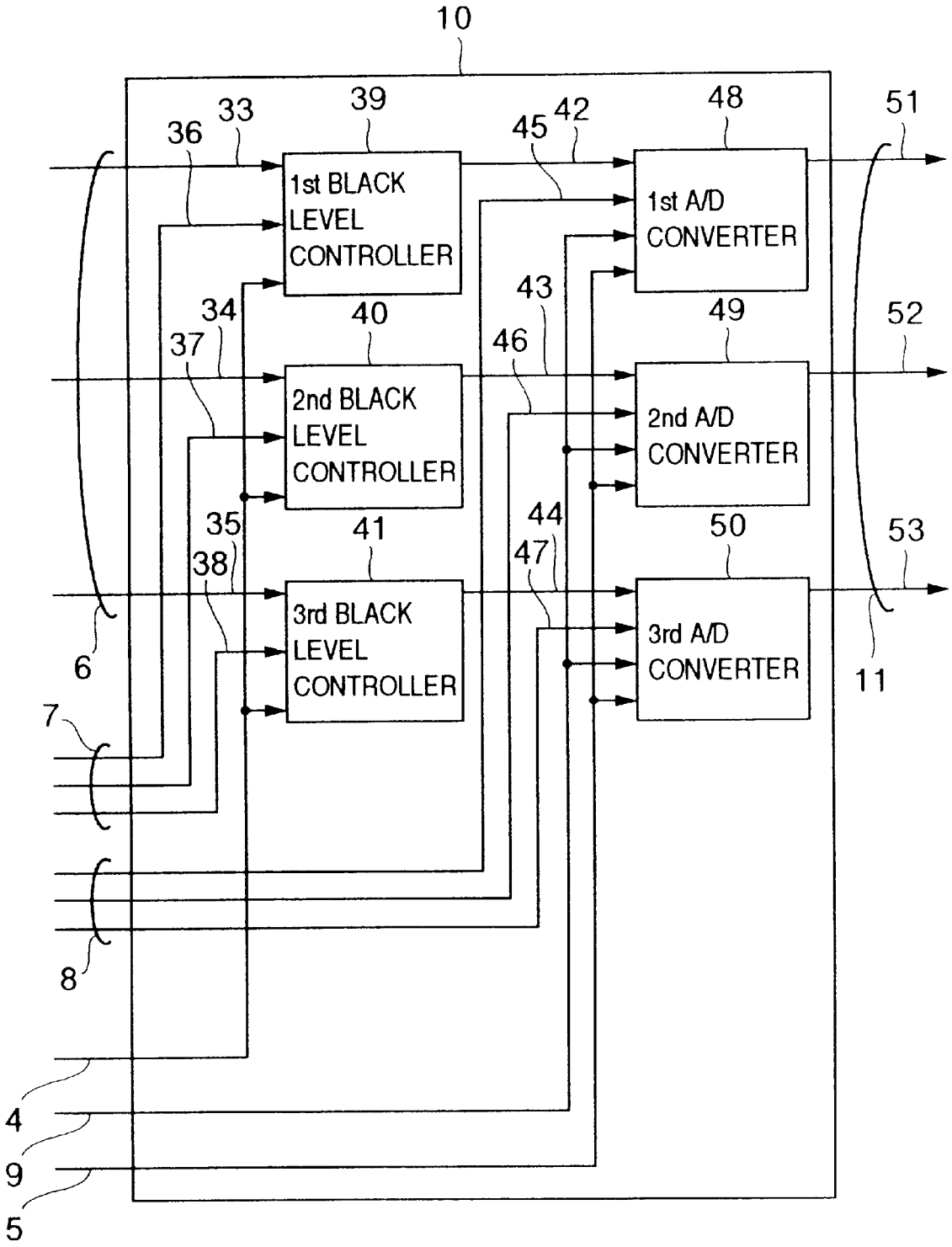
FIG. 2 is a block diagram showing an example of constitution of an A/D converter of FIG. 1.

FIG. 2 is a block diagram showing an embodiment of the A/D converting section 10.

The A/D converting section 10 converts analog display data 6 inputted thereto into digital display data 11. In this connection, the analog display data 6 includes R analog display data 33, G analog display data 34, and B analog display data 35. Additionally, the digital display data 11 includes R digital display data 51, G digital display data 52, and B digital display data 53.

The A/D converting section 10 of the embodiment includes first to third black level adjusters 39 to 41 and first to third A/D converters 48 to 50.

In FIG. 2, reference numerals 33 to 35 respectively indicate R analog display data, G analog display data, and B analog display data of the analog display data 6, numerals 36 to 38 respectively denote first to third offset level components of the offset level 7, numerals 39 to 41 respectively designate first to third black level adjusters, and numerals 42 to 44 respectively stand for black level-adjusted R analog data, black level-adjusted G analog data, and black level-adjusted B analog data. The first black level adjuster 39 adjusts the black level of the R analog display data 33 having an offset amount, which will be described later, according to the black level adjustment timing signal 4 to generate the black level-adjusted R analog data 42 of which the offset amount of the R analog display data 33 is adjusted according the first offset level component 36. The second and third black level adjusters 40 and 41 also accomplish operations similar to the operation above. Reference numerals 45 to 47 respectively indicate first to third gain level components of the gain level 8, numerals 48 to 50 designates first to third A/D converters and numerals 51 to 53 respectively represent R digital display data, G digital display data, and B digital display data. The first A/D converter 48 converts the black level-adjusted R analog data 42 into R digital display data 51 according to the first gain level 45 and the reference low level 9. The second and third A/D converter 49 and 50 also conduct operations similar to the operation described above.

Figure 3A:
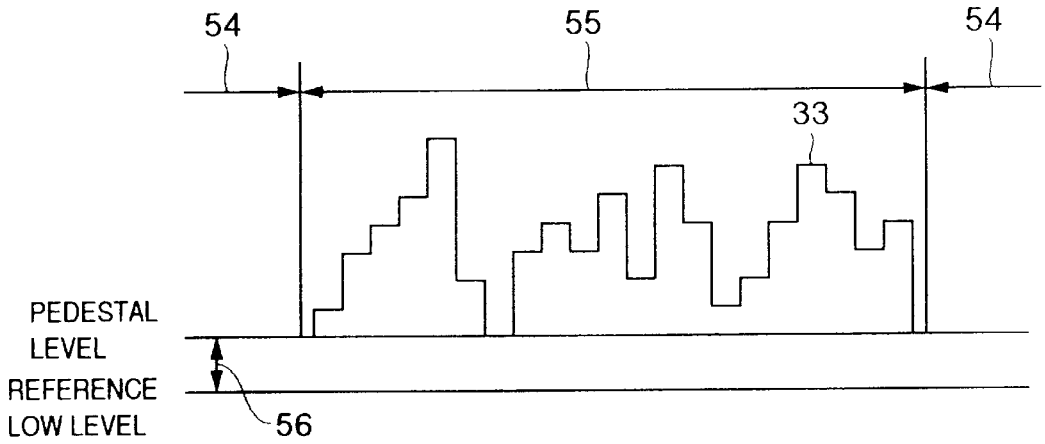
FIGS. 3A and 3B are signal timing charts showing the offset adjustment for analog display data.
Figure 3B:
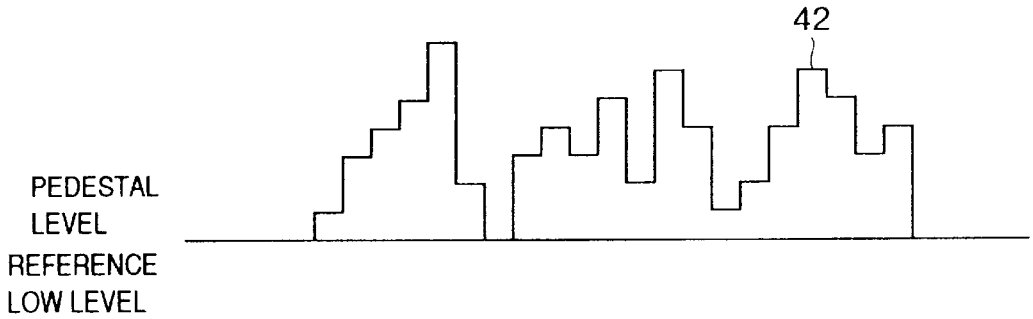

FIGS. 3A and 3B are graphs showing the offset level adjustment by the first black level adjuster 39.

In FIG. 3A, reference numeral 54 indicates a fly-back period which is a non-display period of time of the R analog display data 33 and numeral 56 denotes an offset amount of the R analog display data 33. At timing of the black level adjustment timing signal 4 including pulses generated during the fly-back period 54, the first black level adjuster 39 generates the black level-adjusted R analog data 42 shown in FIG. 3B in which the offset amount, i.e., the difference between the black level or pedestal level of the R analog display data 33 during the fly-back period 54 and the reference low level is adjusted according to the adjustment quantity of the first offset level component 36.

Figure 4:
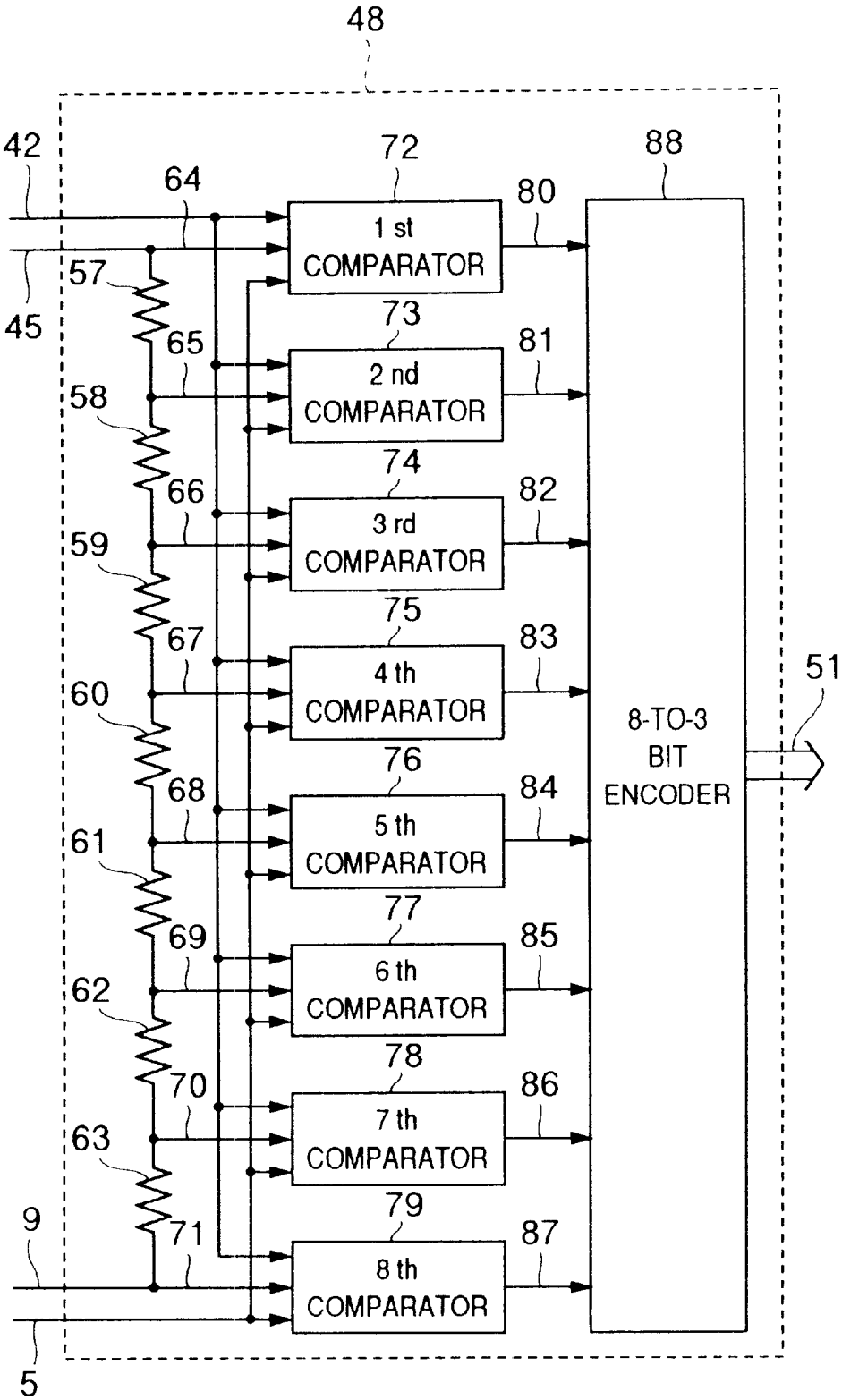
FIG. 4 is a block diagram showing an example of constitution of a first A/D converter of FIG. 2.

FIG. 4 is a block diagram showing an internal configuration of an embodiment of the first A/D converter. As already described, in the description of the embodiment, it is assumed that the A/D converter has a resolution of three bits.

The first A/D converter 48 includes first to seventh voltage dividing resistors 57 to 63, first to eighth comparator 72 to 79, and an 8-to-3 bit encoder 88.

In FIG. 4, reference numerals 57 to 63 indicate the first to seventh voltage dividing resistors and numerals 64 to 71 designate first to eighth reference voltages. The first to seventh voltage dividing resistors 57 to 63 divide a voltage between the first gain level 45 and the reference low level 9 to produce the first to eighth reference voltages 64 to 71. In this description, it is assumed that the resistors have the same resistance value such that the voltage between the first gain level 45 and the reference low level is, for example, equally divided. Reference numerals 72 to 79 represent first to eighth comparators and numerals 80 to 87 denote first to eighth comparator outputs. The first comparator compares the black level-adjusted R analog data 42 with the first reference voltage 64. If the black level-adjusted R analog data 42 is less than the first reference voltage 64, the first comparator outputs "0" as the first comparator output 80 in synchronism with the dot clock 5. Otherwise, the first comparator outputs "1" as the first comparator output 80 in synchronism with the dot clock 5. The second to eights comparators 73 to 79 also carry out operations similar to the operation above to thereby output second to eighth comparator outputs 81 to 87. Reference numeral 88 indicates the 8-to-3 bit encoder, which converts the 8-bit first to eighth comparator outputs 80 to 87 into 3-bit R digital display data 51 and then outputs the data 51 therefrom. The second and third converters 49 and 50 also achieve operations similar to the operation above.

The encoder 88 converts the eight-bit first to eighth comparator outputs 80 to 87 into the three-bit R digital display data 51.

Table 1 show the first to eighth comparator outputs 80 to 87 and the outputs of R digital display data 51 from the 8-to-3 bit encoder 88 in relation to the black level-adjusted R analog data 42.

TABLE 1

| | Comparator output | | | | | | | | Encoder output | | | |
|---|---|---|---|---|---|---|---|---|---|---|---|---|
| | 80 | 81 | 82 | 83 | 84 | 85 | 86 | 87 | 3rd bit | 2nd bit | 1st bit | Remarks |
| 1st reference voltage ≦ input | 1 | 1 | 1 | 1 | 1 | 1 | 1 | 1 | — | — | — | Overflow |
| 2nd reference voltage ≦ input < 1st reference voltage | 0 | 1 | 1 | 1 | 1 | 1 | 1 | 1 | 1 | 1 | 1 | |
| 3rd reference voltage ≦ input < 2nd reference voltage | 0 | 0 | 1 | 1 | 1 | 1 | 1 | 1 | 1 | 1 | 0 | |
| 4th reference voltage ≦ input < 3rd reference voltage | 0 | 0 | 0 | 1 | 1 | 1 | 1 | 1 | 1 | 0 | 1 | |
| 5th reference voltage ≦ input < 4th reference voltage | 0 | 0 | 0 | 0 | 1 | 1 | 1 | 1 | 1 | 0 | 0 | |
| 6th reference voltage ≦ input < 5th reference voltage | 0 | 0 | 0 | 0 | 0 | 1 | 1 | 1 | 0 | 1 | 1 | |
| 7th reference voltage ≦ input < 6th reference voltage | 0 | 0 | 0 | 0 | 0 | 0 | 1 | 1 | 0 | 1 | 0 | |
| 8th reference voltage ≦ input < 7th reference voltage | 0 | 0 | 0 | 0 | 0 | 0 | 0 | 1 | 0 | 0 | 1 | |
| input < 8th reference voltage | 0 | 0 | 0 | 0 | 0 | 0 | 0 | 0 | 0 | 0 | 0 | |

According to Table 1, each comparator compares the input R analog data 42 with a comparison voltage such that if the input voltage is less than the reference voltage, "0" is outputted; otherwise, "1" is outputted. The encoder conducts an encoding operation for each 8-bit comparator output in conformity with Table 1. The similar converting operation is accomplished also for G and B data items.

In this regard, the resolution of A/D converter 10 is not limited to three bits. When it is desired to set the resolution to n bits, it is only necessary that the system configuration includes n comparators and a 2n-to-n bit encoder.

Figure 5:
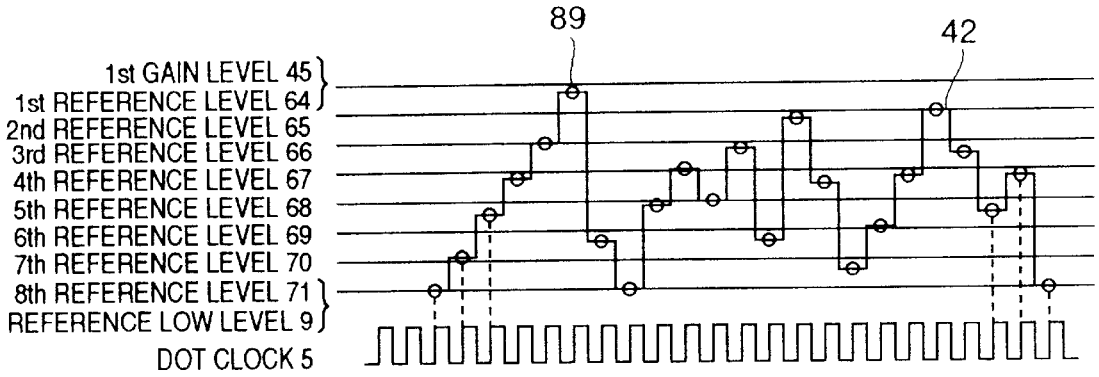
FIG. 5 is a signal timing chart showing operation of the A/D conversion with a proper gain level.

FIG. 5 is a graph showing operations of the A/D converters 48 to 50 of FIG. 2.

In FIG. 5, a reference numeral indicated with a small circle, for example, reference numeral 89 represents a sample point, i.e., an A/D conversion point of the black level-adjusted R data 42 inputted to the first A/D converter 48. Moreover, FIG. 5 shows that the voltage between the first gain level 45 and the reference level 9 is equally divided into first to eight reference voltages 64 to 70.

Table 2 is a table showing outputs from the first to eighth comparators 72 to 79 at the respective sample points of FIG. 5.

TABLE 2

| | Comparator output at each sample point | | | | | | | | | | | | | | | | | | | | | | |
|---|---|---|---|---|---|---|---|---|---|---|---|---|---|---|---|---|---|---|---|---|---|---|---|
| 1st comparator output 80 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 2nd comparator output 81 | 0 | 0 | 0 | 0 | 0 | 1 | 0 | 0 | 0 | 0 | 0 | 0 | 0 | 0 | 0 | 0 | 0 | 0 | 1 | 0 | 0 | 0 | 0 |
| 3rd comparator output 82 | 0 | 0 | 0 | 0 | 1 | 1 | 0 | 0 | 0 | 0 | 0 | 0 | 0 | 1 | 0 | 0 | 0 | 0 | 1 | 0 | 0 | 0 | 0 |
| 4th comparator output 83 | 0 | 0 | 0 | 0 | 1 | 1 | 0 | 0 | 0 | 1 | 0 | 1 | 0 | 1 | 0 | 0 | 0 | 0 | 1 | 1 | 0 | 0 | 0 |
| 5th comparator output 84 | 0 | 0 | 0 | 1 | 1 | 1 | 0 | 0 | 0 | 1 | 1 | 1 | 0 | 1 | 1 | 0 | 0 | 1 | 1 | 1 | 0 | 1 | 0 |
| 6th comparator output 85 | 0 | 0 | 1 | 1 | 1 | 1 | 0 | 0 | 1 | 1 | 1 | 1 | 0 | 1 | 1 | 0 | 0 | 1 | 1 | 1 | 1 | 1 | 0 |
| 7th comparator output 86 | 0 | 1 | 1 | 1 | 1 | 1 | 1 | 0 | 1 | 1 | 1 | 1 | 1 | 1 | 1 | 0 | 0 | 1 | 1 | 1 | 1 | 1 | 0 |
| 8th comparator output 87 | 0 | 1 | 1 | 1 | 1 | 1 | 1 | 0 | 1 | 1 | 1 | 1 | 1 | 1 | 1 | 1 | 1 | 1 | 1 | 1 | 1 | 1 | 0 |

According to Table 2, each comparator compares its input voltage to a comparison voltage such that "0" is outputted if the input voltage is less than the reference voltage; otherwise, "1" is outputted as shown in Table 1.

Table 3 is a table showing the 8-to-3 bit encoder output 51, i.e., the value of digital display data 11 for the outputs 80 to 87 from the first to eighth comparators 72 to 79 of Table 2.

TABLE 3

| Digital display data at each sample point | | | | | | | | | | | | | | | | | | | | | | | | |
|---|---|---|---|---|---|---|---|---|---|---|---|---|---|---|---|---|---|---|---|---|---|---|---|---|
| R Digital display data (encoder output) | Higher bit | 0 | 0 | 0 | 1 | 1 | 1 | 0 | 0 | 0 | 1 | 1 | 1 | 0 | 1 | 1 | 0 | 0 | 1 | 1 | 1 | 0 | 1 | 0 |
| | ↕ | 0 | 1 | 1 | 0 | 1 | 1 | 1 | 0 | 1 | 0 | 0 | 0 | 1 | 1 | 0 | 0 | 1 | 0 | 1 | 0 | 1 | 0 | 0 |
| | Lower bit | 0 | 0 | 1 | 0 | 0 | 1 | 0 | 0 | 1 | 1 | 0 | 1 | 0 | 0 | 0 | 1 | 1 | 0 | 1 | 1 | 1 | 0 | 0 |

As can be seen from Table 3, the 8-to-3 bit encoder operates according to the truth value table of Table 1.

Figure 6:
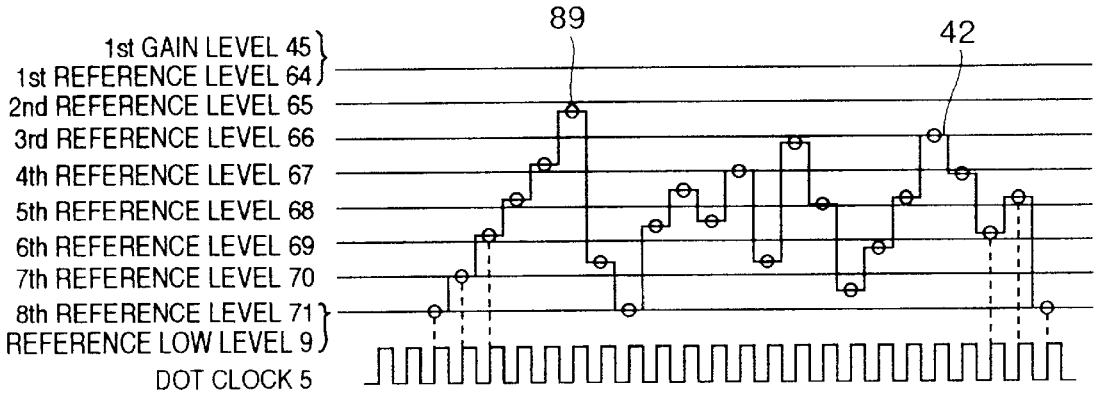
FIG. 6 is a signal timing chart showing operation of the A/D conversion with an inappropriate gain level.

FIG. 6 is a graph showing an embodiment of the A/D conversion when the gain level is altered.

In FIG. 6, although the black level-adjusted R analog data 42 is the same as that of FIG. 5, the first gain level 45 is set to a higher value as compared with that of FIG. 5. In association therewith, the first to eighth reference voltages obtained by equally dividing the voltage between the first gain level and the reference low level are different from those of FIG. 5.

Table 4 is a table showing the outputs 80 to 87 from the first to eighth comparators 72 to 79 at the respective sample points of FIG. 6.

TABLE 4

| Comparator output at each sample point when gain level is changed | | | | | | | | | | | | | | | | | | | | | | | | |
|---|---|---|---|---|---|---|---|---|---|---|---|---|---|---|---|---|---|---|---|---|---|---|---|---|
| 1st comparator output 80 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 2nd comparator output 81 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 3rd comparator output 82 | 0 | 0 | 0 | 0 | 0 | 1 | 0 | 0 | 0 | 0 | 0 | 0 | 0 | 0 | 0 | 0 | 0 | 0 | 1 | 0 | 0 | 0 | 0 | 0 |
| 4th comparator output 83 | 0 | 0 | 0 | 0 | 1 | 1 | 0 | 0 | 0 | 0 | 0 | 0 | 0 | 1 | 0 | 0 | 0 | 0 | 1 | 0 | 0 | 0 | 0 | 0 |
| 5th comparator output 84 | 0 | 0 | 0 | 1 | 1 | 1 | 0 | 0 | 0 | 1 | 0 | 1 | 0 | 1 | 0 | 0 | 0 | 1 | 1 | 1 | 0 | 1 | 0 | 0 |
| 6th comparator output 85 | 0 | 0 | 1 | 1 | 1 | 1 | 0 | 0 | 1 | 1 | 1 | 1 | 0 | 1 | 1 | 0 | 0 | 1 | 1 | 1 | 1 | 1 | 1 | 0 |
| 7th comparator output 86 | 0 | 0 | 1 | 1 | 1 | 1 | 1 | 0 | 1 | 1 | 1 | 1 | 1 | 1 | 1 | 0 | 1 | 1 | 1 | 1 | 1 | 1 | 1 | 0 |
| 8th comparator output 87 | 0 | 1 | 1 | 1 | 1 | 1 | 1 | 0 | 1 | 1 | 1 | 1 | 1 | 1 | 1 | 1 | 1 | 1 | 1 | 1 | 1 | 1 | 1 | 0 |

According to Table 4, since the operation of each comparator is as described in conjunction with Table 2, some outputs are different from those of Table 2 at several sample points because the comparison voltage level is changed. For example, at second sample point, the seventh and eighth comparator outputs are "1" in Table 2; however, only the eighth comparator output is "1" in Table 4.

Table 5 is a table showing the 8-to-3 bit encoder output 51, i.e., the value of digital display data 11 for the outputs 80 to 87 from the first to eighth comparators 72 to 79 of Table 4.

TABLE 5

| Digital display data at each sample point when gain level is changed | | | | | | | | | | | | | | | | | | | | | | | | |
|---|---|---|---|---|---|---|---|---|---|---|---|---|---|---|---|---|---|---|---|---|---|---|---|---|
| R Digital display data (encoder output) | Higher bit | 0 | 0 | 0 | 1 | 1 | 1 | 0 | 0 | 0 | 1 | 0 | 1 | 0 | 1 | 0 | 0 | 0 | 1 | 1 | 1 | 0 | 1 | 0 |
| | ↕ | 0 | 1 | 1 | 0 | 0 | 1 | 1 | 0 | 1 | 0 | 1 | 0 | 1 | 0 | 1 | 0 | 1 | 0 | 1 | 0 | 1 | 0 | 0 |
| | Lower bit | 0 | 1 | 1 | 0 | 1 | 0 | 0 | 0 | 1 | 0 | 1 | 0 | 0 | 1 | 1 | 1 | 0 | 0 | 0 | 0 | 1 | 0 | 0 |

In Table 5, since the operation of the 8-to-3 bit encoder comparator is as described in conjunction with Table 3, the digital data is different from that of Table 3, at sample points at which the comparator outputs vary between Tables 4 and 2.

Figure 7:
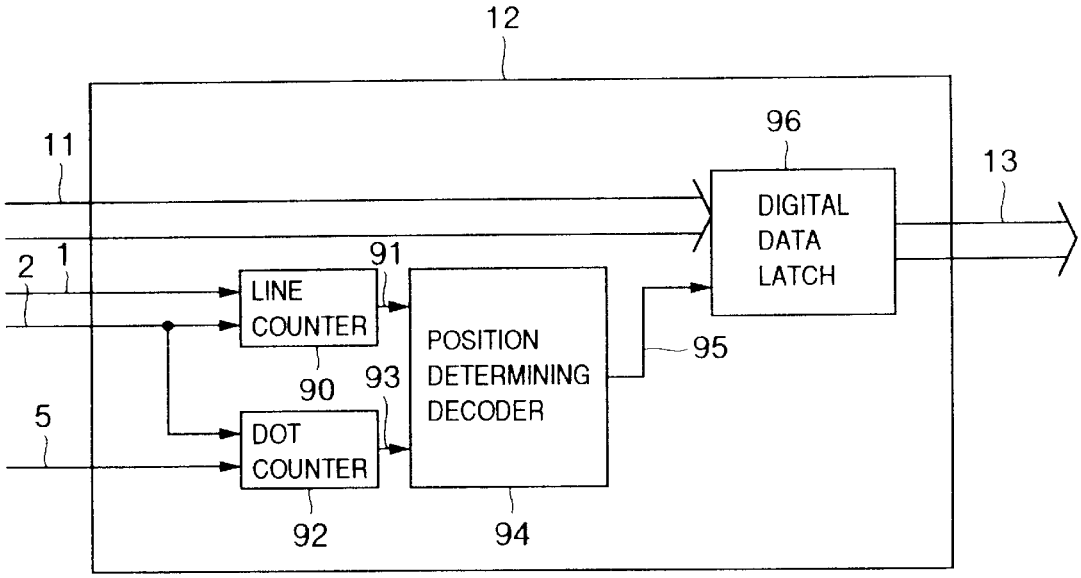
FIG. 7 is a block diagram showing an example of the configuration of a digital display data readout section of FIG. 1.

FIG. 7 is a block diagram showing an embodiment of the digital display data readout section 12.

In FIG. 7, reference numeral 90 indicates a line counter and numeral 91 denotes line count data. The line counter 90 counts the number of horizontal synchronization signals 2 using the vertical synchronization signal as the reference of operation and produces line count data 91 representing a position in the vertical direction. Reference numeral 92 designates a dot counter and numeral 93 stands for dot count data. The dot counter 92 counts the number of dot clocks 5 using the horizontal synchronization signal as the reference of operation and produces dot count data 93 representing a position in the horizontal direction. Reference numeral 94 indicates a position determining decoder and numeral 95 stands for a readout position signal. The decoder 94 generates a pulse at an arbitrary position during one display period according to the line count data 91 and the dot count data 93 to produce the readout position signal 95. Reference numeral 96 denotes a digital latch, which latches the digital display data 11 in response to the readout position signal 95 and then produces readout data 13. Therefore, the digital display data readout section 12 outputs as the readout data 13 for each display period the 1-dot digital data 11 at a position identified by the readout position signal 95 in the display period (screen).

Figure 8:
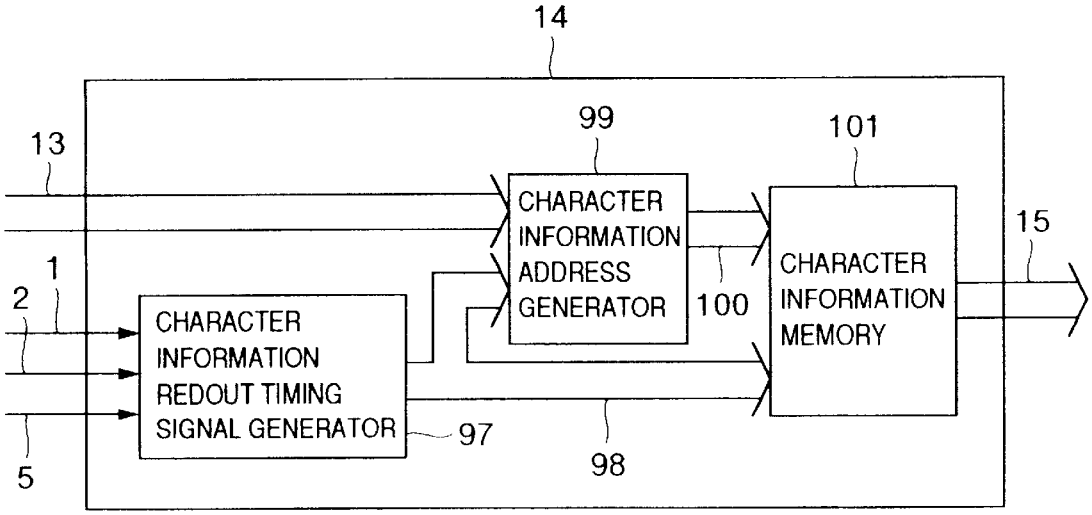
FIG. 8 is a block diagram showing an example of constitution of a character information generating section of FIG. 1.

FIG. 8 shows in a block diagram an embodiment of the character information generating section 14.

In FIG. 8, reference numeral 97 represents a character information readout timing signal generator and numeral 98 indicates a character information readout timing signal. To achieve a readout operation in the character information memory 101, which will be described later, at timing related to a position of the display of character information, the generator 97 generates the timing signal 98 according to the vertical synchronization signal 1, horizontal synchronization signal 2, and dot clock 5. Reference numeral 99 designates a character information address generator and numeral 100 denotes a character information address. The generator 99 generates, according to the readout data 13 and the timing signal 98, the character information address 100 to read out character information. Reference numeral 101 indicates a character information memory, which reads out according to the timing signal 98 character information stored therein at the address 100 and outputs the information as the readout display information (display status indicator) 15.

Figure 9:
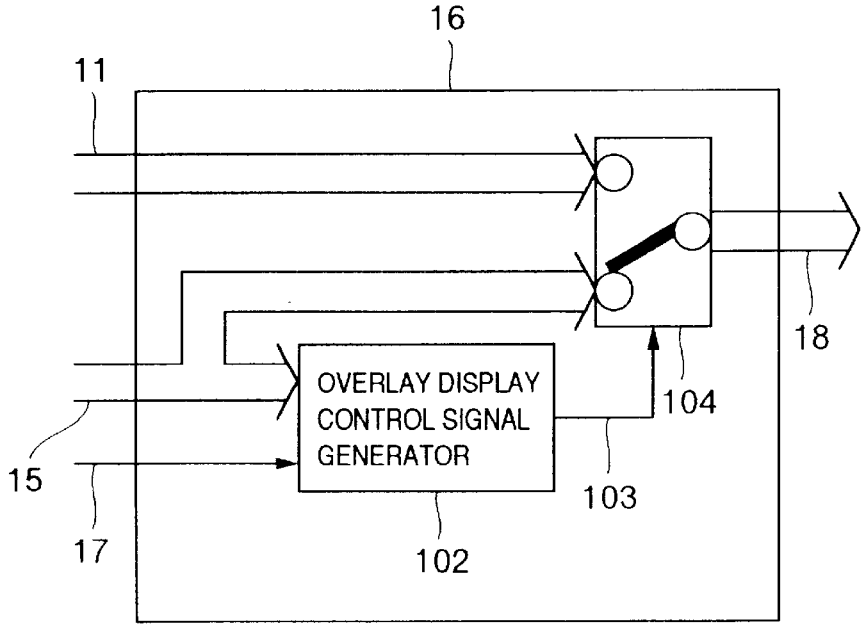
FIG. 9 is a block diagram showing an example of the configuration of a overlay display control section of FIG. 1.

FIG. 9 is a block diagram showing the internal structure of an embodiment of the overlay display controlling section 16.

In FIG. 9, an overlay display control signal generator 102 outputs "1" as an overlay display control signal 103 when the A/D conversion value display control signal 17 is "1". A display data switch 55 is responsive to the control signal 103 to select the readout data display information 15 when the signal 103 is "1" and the digital display data 11 when the signal 103 is "0" and then outputs the selected item as the overlay-controlled display data 18.

Subsequently, referring to FIGS. 1 to 9 and Tables 1 to 5, description will be given of an outline of the operation to read out analog-to-digital (A/D) converted data in the embodiment.

In FIG. 1, the clock generating section 3 regenerates the dot clock 5 having a period of one dot using the horizontal synchronization signal 2 as its operation and then generates from the horizontal synchronization signal 2 the black level adjustment timing signal 4 for offset adjustment, which will be described later. Adjusting the offset level 7, the A/D converting section 10 regulates the black level of the analog display data 6 and converts the data 6 into digital data according to the gain level 8 and the reference low level 9 to produce digital display data 11. Details of the A/D converting operation will be described later by referring to FIG. 4. The digital display data readout section 12 selects an arbitrary display position on the display screen according to the vertical synchronization signal 1, horizontal synchronization signal 2, and dot clock 5 to latch the digital display data 11 at the display position, thereby creating readout data 13 at the display position. To display on the LC panel 32 as character information (display status indicator) the adjustment data (e.g., color adjustment data) concerning the readout data 13 in the overlay mode, the character information generating section 14 produces the readout data display information 15 according to the readout data 13, vertical synchronization signal 1, horizontal synchronization signal 2, and dot clock 5. The overlay display controlling section 16 conducts an overlay display control operation to display the digital display data 11 on the display screen in the overlay mode so as to output the resultant data as overlay controlled display data 18. The display operation of the LC panel 32 is conducted by the LC controller 19, X-driver 26, and Y-driver in the same manner as for the prior art.

Referring now to FIG. 2, details of operation of the A/D converting section 10 of FIG. 1 will be described using R data as an example.

In FIG. 2, the first black level adjuster 39 changes the black level of the R analog display data 33 having an offset amount according to the first offset level 36 to thereby adjust a relationship with respect to the reference low level 9, i.e., the lower reference voltage of the first A/D converter 48 so as to produce black level-adjusted R analog data 42. The first A/D converter 48 converts the data 42 into R digital display data 51 using the first gain level 45 as the higher reference voltage and the reference low level 9 as the lower reference voltage. Details thereof will be described later.

Referring FIGS. 3A and 3B, description will be given in detail of the operation of the R black level adjuster 39 of FIG. 2.

In FIG. 3A, since the R analog display data 33 is at the black level called "pedestal level" during the fly-back period 54, i.e., the non-display period, the offset amount 56 which is the difference between the black level and the reference low level is adjusted in the fly-back period. As result of adjustment, there is produced the black level-adjusted R analog data 42 as shown in FIG. 3B. In this connection, the timing signal for the adjustment is the black level adjustment timing signal 4 which is generated from the horizontal synchronization signal 2 including pulses created during the fly-back period.

The operation of the first A/D converter 48 of FIG. 2. will be described with reference to FIG. 4.

Referring to Table 1, detailed description will be given of operation of the first to eighth comparators 72 to 79 and the 8-to-3 bit encoder 88 of FIG. 4.

As can be seen from Table 1, each comparator compares an input thereto with a comparison voltage such that "0" is outputted for input 42<comparison voltage and "1" is outputted for input 42≧comparison voltage. For example, in a case of sixth reference voltage 69≧input 42<fifth reference voltage 68, the first comparator 72 outputs "0" because of input 42<first reference voltage 64, the second comparator 73 outputs "0" because of input 42<second reference voltage 65, the third comparator 74 outputs "0" because of input 42<third reference voltage 66, the fourth comparator 75 outputs "0" because of input 42 <fourth reference voltage 67, the fifth comparator 76 outputs "0" because of input 42 <fifth reference voltage 68, the sixth comparator 77 outputs "1" because of input 42≧sixth reference voltage 69, the seventh comparator 78 outputs "1" because of input 42≧seventh reference voltage 70, and the eighth comparator 79 outputs "1" because of input 42≧eighth reference voltage 71. Since the embodiment includes eight comparators, nine levels can be set as the condition. However, when the input exceeds the higher reference voltage, there is employed a condition of an overflow. To express conditions of eight remaining levels, the encoder 88 conducts the encoding operation to produce a 3-bit result. In this connection, when the overflow condition is unnecessary, it is also possible to remove one of the comparators.

Referring to FIGS. 5 and 6 and Tables 2 to 5, description will be concretely given of the operations of the comparators 72 to 79 and the encoder 88 as well as the technological advantage of the overlay display of digital data after the A/D conversion as a portion of the primary aspects of the present invention in relation to the gain level adjustment.

In FIG. 5, a sample point 89 indicates timing for the comparators 72 to 79 to achieve the voltage comparison. In this embodiment, the rising edge of dot clock 5 is set as the sample point 89. Table 2 shows the results of comparisons at the respective point. The comparison results are encoded to be then converted into 3-bit digital display data as shown in Table 3. When the gain level is set as shown in FIG. 5, the comparison is appropriately carried out in a range from "1,1,1" representing the maximum luminance to "0,0,0" designating the minimum luminance.

In FIG. 5, the gain level 45 is set so that the maximum value of analog data 42 is between the first reference voltage 64 and the second reference voltage 65.

On the other hand, the analog data 42 of FIG. 6 is similar to that of FIG. 5 such that there is shown a digital conversion when the R gain level is increase as compared with that of FIG. 5 (e.g., the gain level 45 is set such that the the maximum value of analog data 42 is less than the second reference voltage 65). Comparing Table 3, with Table 5 resultant from the conversion, it can be understood that there exists sample points associated with different data. For example, digital data at the second sample point relative to the left-most point is indicated as "0,1,0" and "0,0,1", namely, the luminance of the data is decreased.

Conventionally, the difference cannot be confirmed on the display screen actually presented and hence it is impossible to set an appropriate gain level. According to the present invention, digital data item shown in Tables 3 and 5 can be displayed in an overlapped status and hence the gain adjustment can be appropriately conducted.

Referring next to FIGS. 7 to 9, description will be given of a method of displaying the digital display data 11.

Operation of the digital display data readout section 12 shown in FIG. 1 will be described in detail by referring to FIG. 7.

In FIG. 7, for an area associated with the overlay display on the screen, to select a position in the vertical direction thereof, the line counter 90 counts the number of lines during one display period; whereas, to select a position in the horizontal direction thereof, the dot counter 92 counts the number of dots during one horizontal period. The position determining decoder 94 decodes the results 91 (line count data) and 93 (dot count data) of the respective counting operations to create a readout position signal 95 including pulses produced at timing associated with a display position for the digital data readout operation identified by the data items 91 and 93. It is assumed in this embodiment that the readout position signal 95 is a signal containing one pulse for each display period in relation to an arbitrary one dot in one display period. The digital data latch 96 latches the digital display data 11 in response to the read position signal 95 and outputs the data 11 as the readout data 13. In this case, the digital display data 11 of an arbitrary dot during one display period is latched for each display period.

Referring to FIG. 8, operation of the character information generating section 14 of FIG. 1 will be described in detail.

In FIG. 8, to readout data from the character information memory 101 only at a position where character information is to be displayed, the character information readout timing signal generator 97 generates a character information readout timing signal 98. According to the readout data 13 and the readout timing signal 98 indicating the display position of character information (display status indicator) related to the data 13, the character information address generator 99 creates a character information address 100 designating a readout location of the memory 101. Beforehand stored in the memory 101 is the character information concerning the readout data 13. In this embodiment, the readout data 13 is 3-bit information and hence eight kinds of data are indicated for R, G, and B items. For representation such as "0,0,0" and "8,8,8", it is only necessary to store 83=512 kinds of character information items in the memory 101.

Referring to FIG. 9, description will be given in detail of operation of the overlay display controlling section 16 of FIG. 1.

In FIG. 9, the overlay display control signal generator 102 generates an overlay display control signal 103 according to the readout character information 15 and the A/D conversion value display control signal 17 which is set to "1" for the overlay display. In this situation, it is assumed that the signal 103 is "1" when the readout character information 15 is inputted and the control signal 17 is "1". In response to the signal 103, the display switch 104 selects the display information 15 when the signal 103 is "1" and the display data 11 when In this regard, the configurations of FIGS. 7 to 9 may be also achieved using microcomputers. In such a case, an internal memory of the microcomputer may be adopted as the character information storage.

As above, for the data 13 at a particular position in the display screen attained by the digital display data readout section 12, the character information generating section 14 produces the character information 15 related thereto such that the digital display data 11 and the character information 15 are processed for the overlay display by the overlay display controlling section 16. Therefore, the values of digital data after the digital-to-analog conversion are displayed on the LC panel. Viewing the values, the operator can achieve the color adjustment such as offset and gain level adjusting operations.

Embodiment 2

Next, description will be given of a second embodiment of the present invention, i.e., an embodiment in which the offset and gain levels are automatically adjusted in the A/D converting section 10 using the readout data 13 from the digital display data readout section 12.

Figure 10:
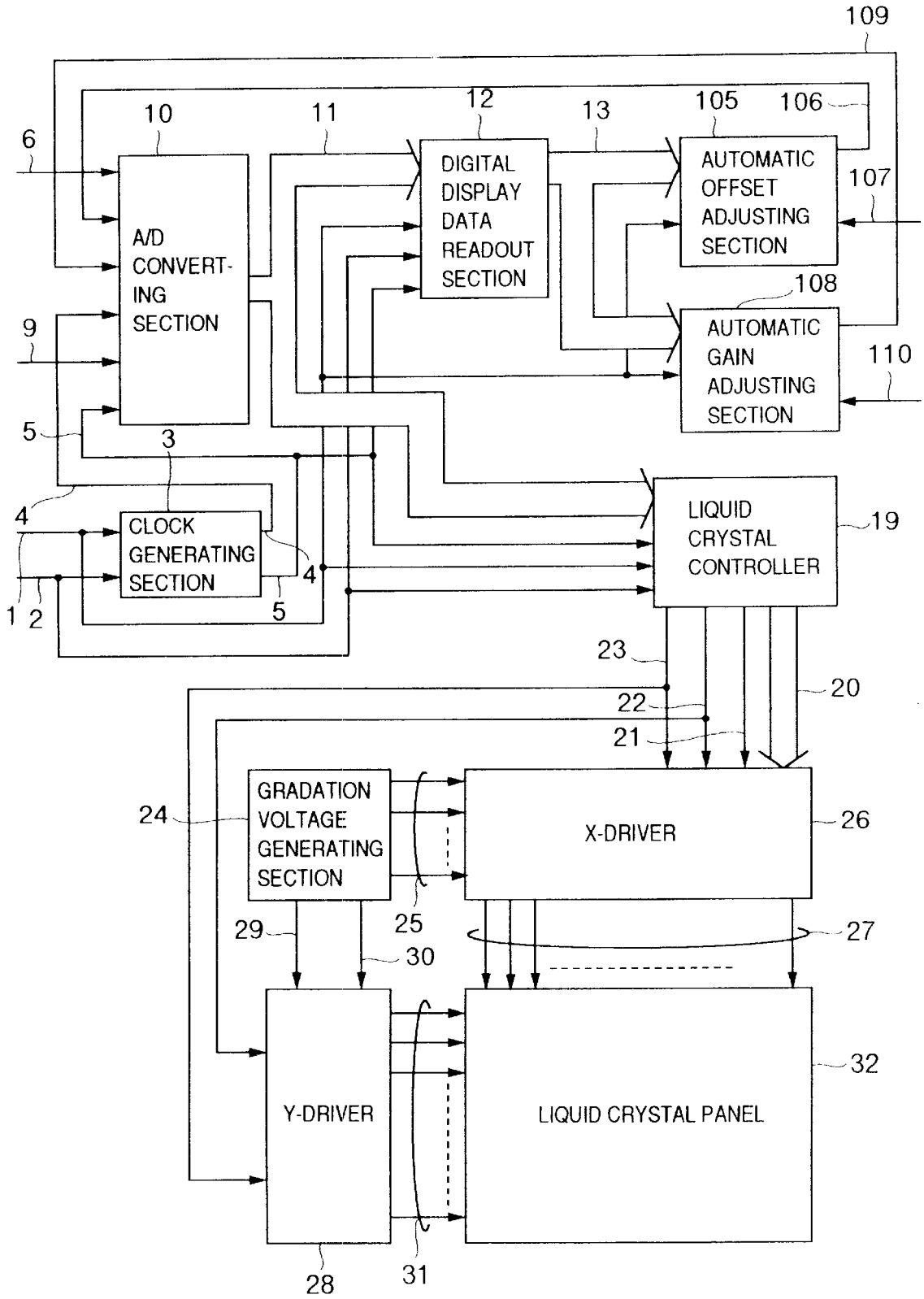
FIG. 10 is a block diagram showing an analog interface liquid crystal display apparatus in an embodiment according to the present invention.

FIG. 10 is a block diagram showing an outline of constitution of the second embodiment of the analog interface liquid crystal display apparatus according to the present invention.

In FIG. 10, reference numeral 105 indicates an automatic offset adjusting section, numeral 106 denotes an adjusted offset level, and numeral 107 represents an offset adjustment start signal. The adjusting section 105 first outputs an initial value for the offset level 106. When the start signal 107 is received, the adjusting section 105 changes the adjusted offset level 106 according to the readout data 13 in synchronism with the vertical synchronization signal 1 to thereby automatically adjust the level 106 to an appropriate level. In the description of this embodiment, it is assumed that the start signal 107 is a pulse signal which is "1" at the start point. Reference numeral 108 stands for an automatic gain adjusting section, numeral 109 designates an adjusted gain level, and numeral indicates a gain adjustment start signal. The adjusting section 108 first outputs an initial value for the adjusted gain level 109. On receiving the start signal 110, the adjusting section 108 changes the gain level 109 according to the readout data 13 in synchronism with the vertical synchronization signal 1 to automatically adjust the level 109 to an appropriate level. It is assumed in the description of this embodiment that the start signal 110 is a pulse signal which is "1" at the start point. Furthermore, the clock generating section 3, A/D converting section 10, digital display data readout section 12, LC controller 19, gradation voltage generating section 24, X-driver 26, Y-driver 28, and LC panel 32 are the same as those of the first embodiment. However, in the description, it is assumed that the readout data 13 includes four bits, namely, one overflow bit for R, G, and B and three bits for digital display data.

Figure 11:
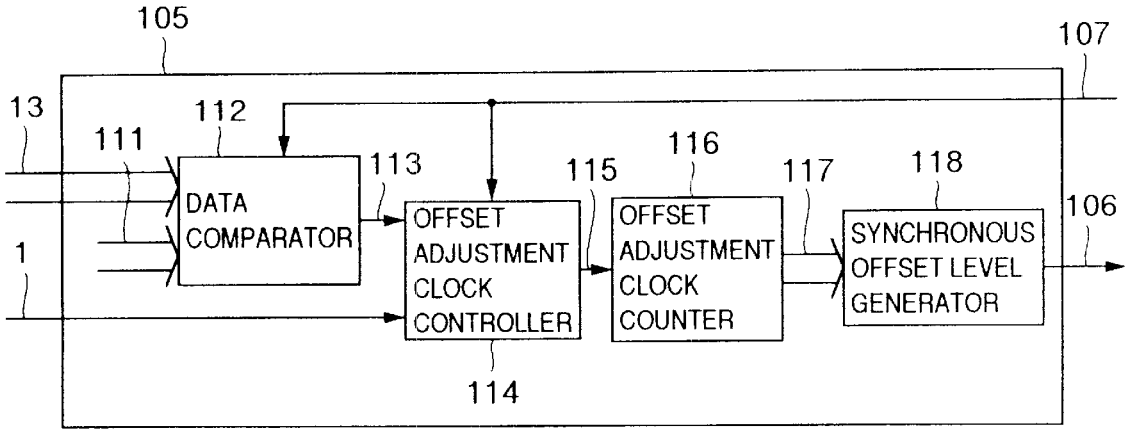
FIG. 11 is a block diagram showing an example of constitution of an automatic offset adjusting section of FIG. 10.

FIG. 11 is a block diagram showing an embodiment of the automatic offset adjusting section 105.

In FIG. 11, reference numeral 111 is reference data prepared in advance, numeral 112 denotes a data comparator, and numeral 113 designates a data comparison output. The comparator 112 compares the reference data 111 with the readout data 13 to output the comparison result as the data comparison output 113. In this embodiment, for the readout data 13, three bits selected from the display data are used, i.e., the one overflow bit is not employed. Consequently, it is assumed in the description that the reference data 111 is 3-bit "0" and the data comparison output 113 is "1" when the comparison results in "matching". Reference numeral 114 denotes an offset adjustment clock controller and numeral 115 indicates an offset control clock. The controller 114 outputs the vertical synchronization signal 1 as the offset control clock 115 beginning at the "1" pulse of the start signal 107 until the output 113 from the comparator 112 becomes "1". Therefore, in any other cases, the vertical synchronization signal 1 is masked. Reference numeral 116 denotes an offset adjustment clock counter, numeral 117 represents an output from the counter 116, and numeral 118 stands for a synchronous offset level generator. The counter 116 achieves initialization responsive to the start signal 107 to start counting the clock 115 so as to generate a count output 117. The synchronous offset generator 118 outputs an adjusted offset level 106 which is analog data associated with the value of the count output 117 from the counter 116.

Figure 12:
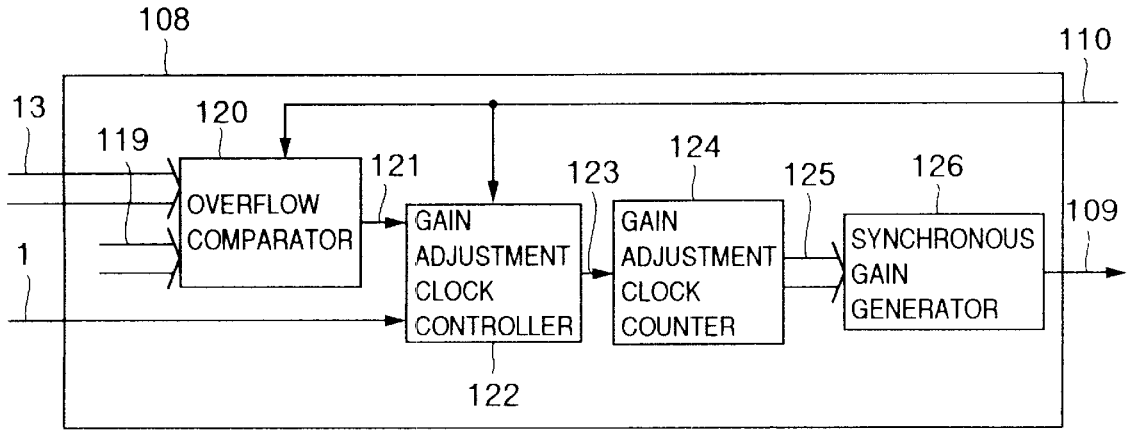
FIG. 12 is a block diagram showing an example of the configuration of an automatic gain adjusting section of FIG. 10.

FIG. 12 is a block diagram showing an embodiment of the automatic gain adjusting section 108.

In FIG. 12, reference numeral 119 denotes reference data beforehand prepared, numeral 120 indicates an overflow comparator, and numeral 121 designates an overflow comparison output. The comparator 120 compares the readout data 13 with the reference data 119 to output a comparison result as the overflow comparison output 121. In the description of the embodiment, it is assumed that for the readout data 13, there is used data including bits which is set to "1" at an occurrence of the overflow, the reference data 119 hence includes one bit of "0", and the overflow comparison output 121 outputs "1" when the comparison results in "matching". Reference numeral 122 represents a gain adjustment clock controller and numeral 123 stands for a gain adjustment clock. The controller 122 outputs the vertical synchronization signal 1 as the gain adjustment clock 123 beginning at the "1" pulse of the start signal 110 until the output 121 becomes "1". Consequently, in any other cases, the vertical synchronization signal 1 is masked. Reference numeral 124 indicates a gain adjustment counter, numeral 125 denotes a count output, and numeral 126 designates a synchronous gain level generator. The counter 124 conducts initialization in response to the start signal 110 to count the clock 123 and thereby outputs the count output 125. The generator 126 outputs an adjusted gain level 109, which is analog data according to the value of the output 125 from the counter 124.

Figure 13:
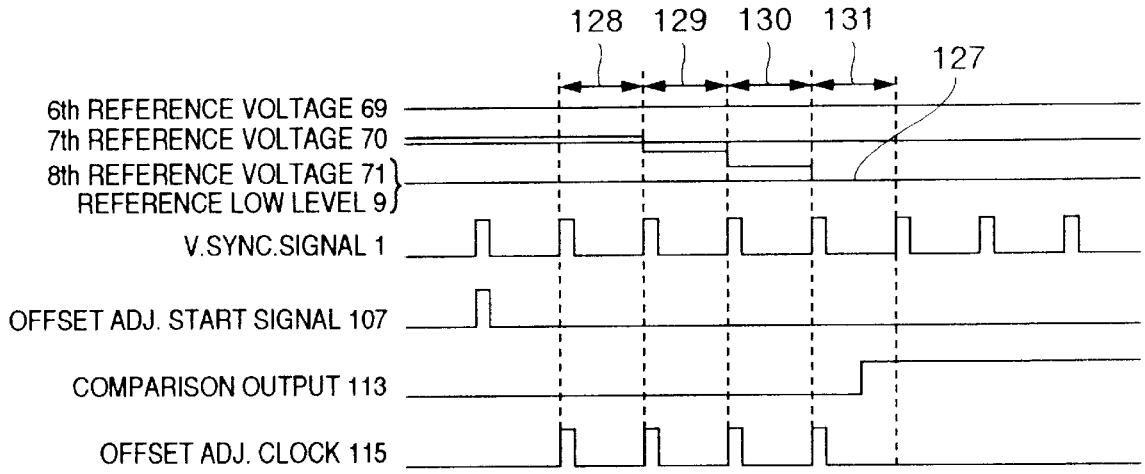
FIG. 13 is a signal timing chart showing operation of automatically adjusting the offset level.

FIG. 13 is a graph showing in detail the operation of the automatic offset level adjusting section 105.

In FIG. 13, reference numeral 127 denotes an analog data representative of "black" (black level analog data), numeral 128 indicates a first offset adjustment duration, numeral 129 designates a second offset adjustment duration, numeral 130 stands for a third offset adjustment duration, and numeral 131 designates a fourth offset adjustment duration. The offset adjustment clock controller 114 outputs the vertical synchronization signal 1 as the offset adjustment clock 115 beginning at a display period or duration next to the display duration in which the start signal 107 is inputted. The first pulse of the clock 115 is set as the start point of the first offset adjustment duration 128 and the initial value of offset level is set to the A/D converting section 10. Thereafter, for the second to fourth offset adjustment durations 129 to 131, the offset level 7 is sequentially decreased in synchronism with the second to fourth pulses of the clock 115. Resultantly, in the first offset adjustment duration 128, the value of the output 11 from the digital converting section 10, i.e., the output 13 from the digital display data readout section 12 is not "0,0,0" according to Table 1; however, in the fourth offset adjustment duration 131, the value becomes "0,0,0", indicating that an appropriate offset level is attained. The offset level generator 118 then outputs the adjusted offset level 106 to stop the offset adjustment clock 115 beginning at the next display duration. The automatic offset level adjustment is thereby completed.

Figure 14:
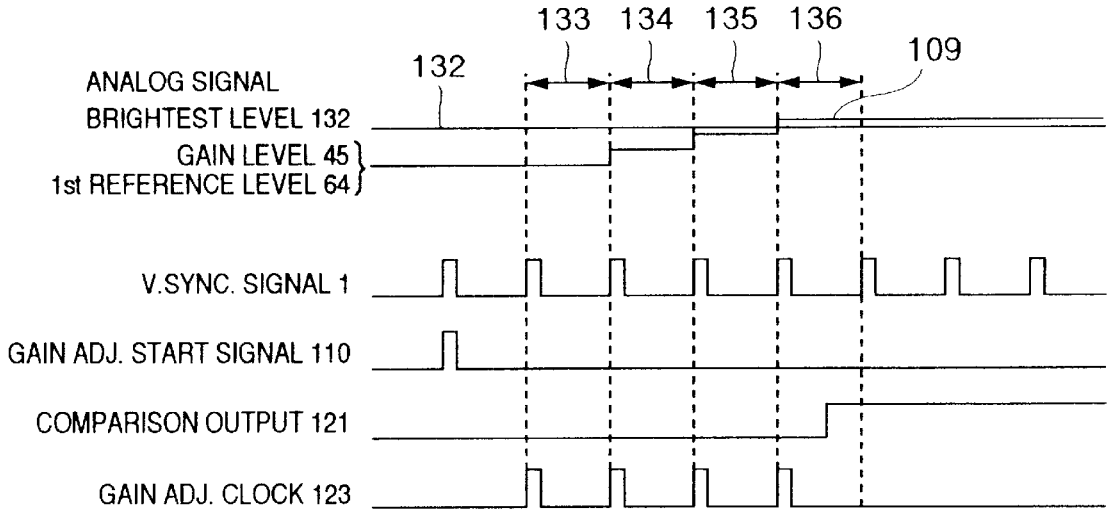
FIG. 14 is a signal timing chart showing operation of automatically adjusting the gain level.

FIG. 14 is a graph showing details of operation of the automatic gain level adjusting section 108.

In FIG. 14, reference numeral 132 denotes a maximum value of the analog display data 6 inputted to the A/D converting section 10, numeral 133 indicates a first gain adjustment duration, numeral 134 indicates a second gain adjustment duration, numeral 135 indicates a third gain adjustment duration, and numeral 136 indicates a fourth gain adjustment duration. The gain adjustment clock controller 122 outputs the vertical synchronization signal 1 as the gain adjustment clock 123 beginning at a display duration next to the display duration in which the start signal 110 is inputted. The first pulse of the clock 123 is set as the start point of the first gain adjustment duration 133 and the initial value of gain level is set to the A/D converting section 10. Thereafter, for the second to fourth gain adjustment durations 134 to 136, the gain level is sequentially increased in synchronism with the second to fourth pulses of the clock 123, thereby increasing the first reference voltage 64, i.e., the gain level 8. Resultantly, in the first gain adjustment duration 133, the overflow bit of the output 11 from the digital converting section 10, i.e., the output 13 from the digital display data readout section 12 is "1" according to Table 1 described above. When the value "1" of the overflow bit is changed to "0" in the fourth gain adjustment duration 136, there is obtained an appropriate gain level. The gain level generator 126 then outputs the adjusted gain level 109 to stop the offset adjustment clock 123 beginning at the next display duration. The automatic gain level adjustment is thereby completed.

Referring next to FIGS. 10 to 14, description will be given an outline of the automatic offset adjustment, automatic gain adjustment, A/D conversion, and operation of reading out digital data for the overlay display in the present embodiment.

In FIG. 10, the operations of the clock generating section 3, A/D converting section 10, and digital display data readout section 12 are similar to those of the first embodiment. When conducting the automatic offset and gain adjustment, the offset adjustment start signal 107 and the gain adjustment start signal 110 are respectively inputted to the automatic offset adjusting section 105 and the automatic gain adjusting section 108 such that the adjusting sections 105 and 108 respectively adjusts the offset and gain levels respectively according to the signals 107 and 110 to thereby respectively outputs the adjusted offset and gain levels 106 and 109, which will be described below in detail. The signals 107 and 110 may be arbitrarily inputted or may be inputted each time the apparatus is initialized. The operations of the LC controller 19, gradation voltage generating section 24, X-driver 26, Y-driver 28, and LC panel 32 are almost the same as those of the first embodiment.

Referring to FIG. 11, description will be given in detail of operation of the automatic offset adjusting section 105 shown in FIG. 10.

In FIG. 11, the data comparator 112 compares the reference data beforehand prepared 111 with readout data 13 obtained when what is displayed on the LC panel 32 is at the black level, to determine whether or not each bit of the readout data 13 is "0", i.e., whether or not the A/D conversion is correctly accomplished in the black-level display operation. In this case, it is assumed that the comparator 112 outputs "0" as the data comparison output 113 when mismatching occurs for either one of the bits and "1" when matching takes place for all bits. The offset adjustment clock controller 114 outputs the vertical synchronization signal 1 as the offset adjustment clock 115 according to the offset adjustment start signal 107 inputted when the automatic offset adjustment is to be conducted. When the data comparison output 113 becomes "1", the controller 114 masks the vertical synchronization signal 1. The offset adjustment clock counter 116 counts the number of pulses of the clock 115 according to the start signal 107 to generate the count output 117. The synchronous offset generator 118 creates an analog value corresponding to the value of the count output 117 to output the analog value as the adjusted offset level 106. Therefore, the level 106 changes in synchronism with the offset adjustment clock 115. In this connection, the generator 118 converts a digital value into an analog value and hence may be implemented by a D/A convertor may be configured with digital variable resistors to divide the reference voltage.

Referring FIG. 13, description will be given in detail of operations of the offset adjustment clock controller 114, offset adjustment counter 116, and synchronous offset level generator 118 of FIG. 11.

In FIG. 13, when the automatic offset adjustment is to be conducted, "black display" is set as the display designation and then analog data representative of "black" (black level analog data) 127 is inputted to to the A/D converting section 10. Beginning at a display time period next to the display time period in which the offset adjustment start signal 107 is inputted, the first pulse of the offset adjustment clock 115 is supplied to the counter 116 and then the offset generator 118 sets the initial value of the offset level (data 127 in the first offset duration 128). When setting the initial value, the black display level 127 is set to be higher than the reference low level 9. Specifically, the discrepancy is about (higher reference voltage 64 of A/D converter–lower reference voltage 71 thereof)/(resolution (number of bits of data 13)–1). Reference is to be made to FIG. 4. Therefore, since the black level analog data 127 is higher than the seventh comparison voltage 70, the digital data after the A/D conversion during the first offset adjustment period 128 is attained as "0,1,0" according to Table 1 described above. Since the comparison output is "0" in this situation, the offset level (the value of the black level analog data 127) is reduced thereafter along the second to fourth offset adjustment periods 129 to 131 in synchronism with pulses of the offset adjustment clock 115. The output 11 from the A/D converting section 10, i.e., the digital data 13 from the digital display data readout section 12 is "0,0,1" in the second offset adjustment period 129, "0,0,1" in the third offset adjustment period 130, and "0,0,0" in the fourth offset adjustment period 131. At this point, the output from the comparator 112 becomes "1" and the offset adjustment clock 115 is stopped beginning at the next display duration, which decides an optimal offset level. The smaller the step of reducing the offset level is, the higher the precision of adjustment is. The step is required to be less than (higher reference voltage of A/D convertor–lower reference voltage thereof)/(resolution–1).

Referring to FIG. 12, description will be given in detail of operation of the automatic gain adjusting section 108 shown in FIG. 10.

In FIG. 12, the overflow comparator 120 compares the reference data prepared in advance 119 with the readout data 113 obtained when the display item is at the white level on the LC panel to determine whether or not the overflow bit of the readout data 13 is "0", i.e., whether or not the A/D conversion is correctly accomplished in the white-level display operation. In this case, it is assumed that the comparator 112 outputs "0" as the overflow comparison output 121 when mismatching occurs between the overflow bit of the readout data 13 and that of the reference data 119 and "1" when matching takes place therebetween. The gain adjustment clock controller 122 outputs the vertical synchronization signal 1 as the gain adjustment clock 123 according to the offset adjustment start signal 110 inputted when the automatic gain adjustment is to be conducted. When the comparison output 121 becomes "1", the controller 122 masks the vertical synchronization signal 1. The gain adjustment clock counter 124 counts the number of pulses of the clock 123 according to the start signal 110 to generate the count output 125. The synchronous gain generator 126 creates an analog value corresponding to the value of the count output 125 to output the analog value as the adjusted gain level 109. Therefore, the level 109 changes in synchronism with the gain adjustment clock 123. In this connection, the generator 126 converts a digital value into an analog value and hence may be implemented by a D/A convertor may be configured with digital resistors to divide the reference voltage.

Referring FIG. 14, description will be given in detail of operations of the gain adjustment clock controller 122, gain adjustment counter 124, and synchronous gain level generator 126 of FIG. 12.

In FIG. 14, when the automatic gain adjustment is to be conducted, "white display" is set as the display designation and then analog data representative of "white" (white level analog data) 132 is inputted to to the A/D converting section 10. Beginning at a display time period next to the display time period in which the gain adjustment start signal 110 is inputted, the first pulse of the gain adjustment clock 123 is supplied to the counter 124 and then the gain generator 126 sets the initial value of the gain level (data 64 in the first gain duration 133). The initial value is set to a lower value so that the value after the digital conversion, i.e., the readout data 13 causes an overflow. Specifically, the discrepancy with respect to the higher reference voltage 64 of the A/d converter is about (higher reference voltage 64 of A/D converter–lower reference voltage 71 thereof)/(resolution (number of bits of data 13)–1). Reference is to be made to FIG. 4. Therefore, since the white level analog data 132 is higher than the first comparison voltage 64, the overflow bit after the A/D conversion during the first gain adjustment period 133 is attained as "1" according to Table 1 described above. Since the comparison output is "0" in this situation, the gain level (the value of the first reference voltage 64) is reduced thereafter along the second to fourth gain adjustment periods 129 to 131 in synchronism with pulses of the gain adjustment clock 123. In this case, the overflow bit after the A/D conversion is "1" in the second gain adjustment period 129, "1" in the third gain adjustment period 130, and "0" in the fourth gain adjustment period 131. At this point, the output from the comparator 120 becomes "1" and the gain adjustment clock is stopped beginning at the next display duration, which decides an optimal gain level. The smaller the step of increasing the gain level is, the higher the precision of adjustment is. The step is required to be less than (higher reference voltage of A/d convertor–lower reference voltage thereof)/(resolution–1).

According to the embodiment, the digital display data 13 after the A/D conversion is read out to be compared with an expected value. When the expected result is not attained, the offset and gain levels are adjusted in synchronism with the vertical synchronization signal to automatically establish the optimal offset and gain levels.

Embodiment 3

In the liquid crystal (LC) display apparatus according to this embodiment, when adjusting the offset and gain in an automatic manner, it is unnecessary to display any black-level and white-level images for the adjustment.

Figure 15:
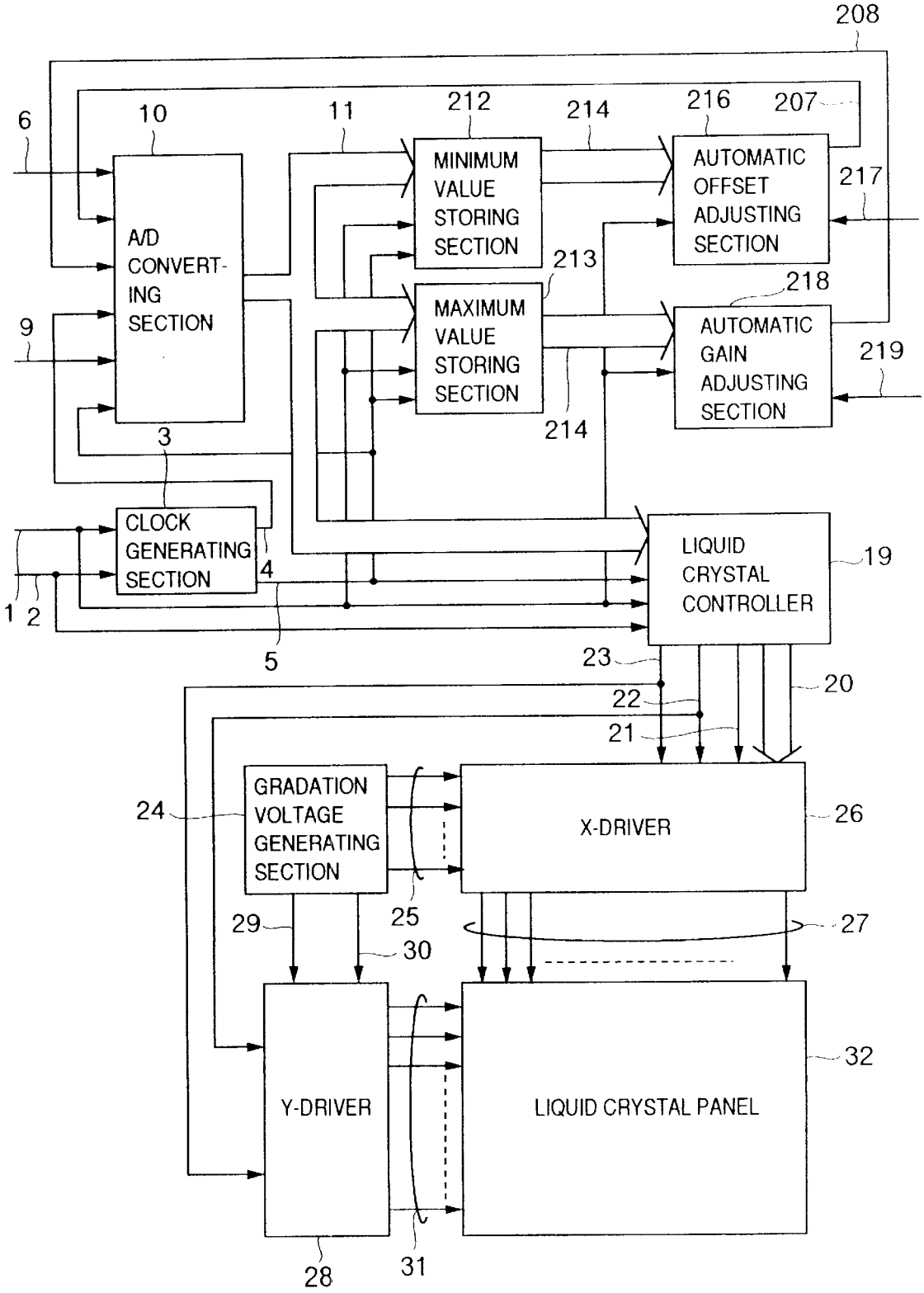
FIG. 15 is a block diagram showing an analog interface liquid crystal display apparatus in an embodiment according to the present invention.

First, an outline of the LC display apparatus will be described with reference to FIG. 15.

The LC display apparatus includes a clock generating section 3, an A/D converting section 10, a minimum value storing section 212, a maximum value storing section 213, an automatic offset adjusting section 216, an automatic gain adjusting section 218, a liquid crystal controller 19, a gradation voltage generating section 24, an X-driver 26, a Y-driver 28, and a liquid crystal panel 32.

The clock generating section 3 reproduces, according to a vertical synchronization signal 1 and a horizontal synchronization signal 2, which are inputted from an analog interface of, for example, a personal computer, the dot clock 5 and generates a black level adjustment timing signal 4 to create a pulse during a fly-back period, which will be described later. In this connection, the signal 4 is adopted to generate a pulse during a fly-back period, which will be described later.

The A/D converting section 10 converts analog display data 6 inputted from the analog interface into digital display data 11 according to the black level adjustment timing signal 4, dot clock 5, offset level 207, gain level 208, and reference low level 9. In this regard, the reference low level 9 is the lower reference voltage in the A/D conversion. In this embodiment, it is assumed that the conversion section 10 has a precision of three bits and the digital display data 11 includes 3-bit data.

The minimum value storing section 212 acquires the digital display data 11 for each dot on the display screen in synchronism with the dot clock 5 and then compares the acquired data with stored data for each data acquisition to keep either one of the data items having a smaller value. According to the vertical synchronization signal 1, the storing section 212 outputs the stored value as minimum value data 214 to the automatic offset adjusting section 216. Additionally, the contents of the storing section 212 are cleared when the minimum value data 214 is outputted. Therefore, from the minimum value storing section 212, the minimum value of the digital display data 11 during one display time period is outputted as the minimum value data 214 for each display period. The the storing section 212 is required to have a capacity for the number of bits of digital display data for R, G, and B components. In this embodiment, the section 212 includes nine bits (3×3 bits). When the number of bits of display data is increased, it is only necessary to increase the number of bits of the storing section 212.

In this connection, it is assumed in the embodiment that the minimum data 214 is outputted in synchronism with the vertical synchronization signal 1. However, it may also possible to output the data at arbitrary timing only when the automatic adjustment is to be achieved. However, the clearing of the stored value is to be accomplished at timing of the vertical synchronization signal 1.

The automatic offset adjusting section 216 is provided to create the offset level 207 to adjust the offset in the A/D converting section 10. The adjusting section 216 first outputs an initial value for the offset level 207. However, when the offset adjustment start signal 217 is inputted, for example, by operating a switch at an arbitrary location of the display apparatus, the offset level 207 is automatically adjusted to an optimal level according to the minimum value data 214. The adjustment is carried out in synchronism with the vertical synchronization signal 1. In this embodiment, it is assumed that the offset adjustment start signal 217 is a pulse signal which is "1" when the automatic adjustment of the offset level is started. The configuration and operation of the offset adjusting section 216 will be described later in detail. In this regard, the offset level 207 also includes an R offset level, a G offset level, and a B offset level, which are similar to levels 36 to 38 shown in FIG. 2.

The maximum value storing section 213 acquires the digital display data 11 for each dot on the display screen in synchronism with the dot clock 5 and then compares the acquired data with stored data for each data acquisition to keep either one of the data items having a larger value. According to the vertical synchronization signal 1, the storing section 213 outputs the stored value as maximum value data 215 to the automatic gain adjusting section 218. Additionally, the contents of the storing section 213 are cleared when the maximum value data 215 is outputted. Therefore, from the maximum value storing section 213, the minimum value of the digital display data 11 during one display time period is outputted as the maximum value data 215 for each display period. The the storing section 213 is required to have a capacity of (number of bits of digital display data+overflow bit) for R, G, and B components. In this embodiment, the section 213 includes 12 bits (=4×3 bits). When the number of bits of display data is increased, it is only necessary to increase the number of bits of the storing section 213.

In this connection, it is assumed in the embodiment that the maximum data 215 is outputted in synchronism with the vertical synchronization signal 1. However, it may also possible to output the data at arbitrary timing only when the automatic adjustment is to be achieved. However, the clearing of the stored value is to be accomplished at timing of the vertical synchronization signal 1.

The automatic gain adjusting section 218 is provided to create the gain level 208 to adjust the offset in the A/D converting section 10. The adjusting section 218 first outputs an initial value for the gain level 208. However, when the gain adjustment start signal 219 is inputted, for example, by operating a switch at an arbitrary location of the display apparatus, the gain level 208 is automatically adjusted to an optimal level according to the maximum value data 215. The adjustment is carried out in synchronism with the vertical synchronization signal 1. In this embodiment, it is assumed that the gain adjustment start signal 218 is a pulse signal which is "1" when the adjustment is started. The configuration and operation of the gain adjusting section 218 will be described later in detail. In this regard, the gain level 207 also includes an R gain level, a G gain level, and a B gain level, which are similar to levels 45 to 47 shown in FIG. 2.

The LC controller 19 rearranges, as in the prior art, the digital display data 11 into an array of pixels of LC panel 32, which will be described later, to produce LC display data 21, and then outputs the data 21 in synchronism with a latch clock 21 generated according to the dot clock 5. Moreover, the controller 19 is used to produce a horizontal clock 22 as scan timing for each line and a first line signal 23 indicating a first position of one display period.

The X-driver 26 sequentially acquires, as with the conventional system, one line of LC display data 20 in response to the latch clock 21, selects according to data of each dot one of the gradation voltage levels 25 created by the gradation voltage generating section 24, and outputs the level as panel data 27 in synchronism with the next horizontal clock 22. It is assumed in this description that the LC panel, which will be described later, has 640 horizontal dots, 640×3 (one dot for red, blue, and blue)=1920×signal lines, and eight gradation voltage levels 25.

The Y-driver 28 obtains the first line signal 23 and applies a selection voltage 30 to the first line of the scan signal lines 31 to set the first signal line to the selected status. In synchronism with the subsequent horizontal clocks 22, the Y-driver 28 changes the object of the application of selection voltage 30 in the scan signal lines 31 in an order of the second line, third line, etc. Any lines of the group of lines 31 other than those applied with the selection voltage 30 are applied with a non-selection voltage 29. It is assumed in this description that the LC panel, which will be described later, has 480 vertical dots and 480 Y signal lines.

The LC panel 32 displays, according to panel data 27 outputted from the X-driver 26, data on the lines of scan signal lines 31 to which the selection voltage 30 is applied. Additionally, as in the conventional technology, the LC panel 32 possesses the red (R), green (G), and blue (B) filters to configure one dot with three pixels so as to conduct the color display through additive color mixture. As already described, it is assumed in this embodiment, the LC panel 32 has a resolution of 640×480 and eight gradation levels for R, G, and B and can display 512 colors.

The clock generating section 3 generates the dot clock 5 according to the vertical and horizontal synchronization signals 1 and 2 inputted from the analog interface and supplies the clock 5 to the A/D converting section 10, LC controller 20, minimum value storing section 12, and maximum value storing section 13. Moreover, the clock generating section 3 creates the black level adjustment timing signal 4 to feed the signal 4 to the A/D converting section 10. The signal 4 is utilized in the offset adjustment, which will be described later. It may also be possible to employ either one of the combinations including a combination of the minimum storing section 212 and automatic offset adjusting section 216 and a combination of the maximum storing section 213 and automatic gain adjusting section 218.

Description will be given of the LC display apparatus shown in FIG. 15.

The A/D converting section 10 adjusts the black level of analog display data 6 according to the offset level 207. According to the gain level 208 and a reference low level 9 generated according to a reference power source, now shown, the converting section 10 converts analog display data 6 into digital display data 11 to output the data 11 to the LC controller 19.

The display operation on the LC panel 32 by the LC controller 19, X-driver 26, and Y-driver 28 is similar to that of the prior art. Namely, the LC controller 19 controls the X-driver 26 and Y-driver 28 to display the input digital display data 11 on the LC panel 32. In the situation, the gradation voltage to be applied to the LC panel 32 is separately generated by the gradation voltage generating section 24.

In this connection, the gain and offset values of A/D conversion by the A/D converting section 10 are required to be adjusted according to the input digital display data 11. Therefore, in the embodiment, the minimum value of digital display data 11 is kept in the minimum value storing section 212. According to the minimum value, the automatic offset value adjusting section 216 adjusts the offset level 207.

Additionally, the maximum value of digital display data 11 is kept in the maximum value storing section 213. According to the maximum value, the automatic gain value adjusting section 218 adjusts the gain level 208. The A/D converting section 10 adjusts the offset and gain of the A/D conversion according to the offset level 207 and the gain level 208. Resultantly, the offset and gain are automatically set to optimal values.

In this regard, the automatic offset and gain adjusting sections 216 and 218 outputs initial levels when the power is turned on. When the offset and gain adjustment start signals 217 and 219 are respectively inputted, the sections 216 and 218 starts the automatic adjusting operations of the offset and gain levels 207 and 208. The signals 217 and 219 may be arbitrarily inputted or may be inputted each time the apparatus is initialized.

Since the aspect of the embodiment primarily resides in the automatic offset and gain adjusting operations, description will be given mainly on the aspect in the following paragraphs.

The A/D converting section 10 may be constructed in a manner similar to, for example, the manners of configuring the systems shown in FIGS. 2 to 4.

Consequently, the offset level 7 is replaced with the adjusted offset level 207 supplied from the automatic offset adjusting section 216; whereas, the gain level 8 is substituted for the adjusted gain level 208 supplied from the automatic gain adjusting section 218.

First, description will be given of a relationship between the gain and offset levels and results of A/D conversion with reference to FIGS. 16 to 19.

Figure 18:
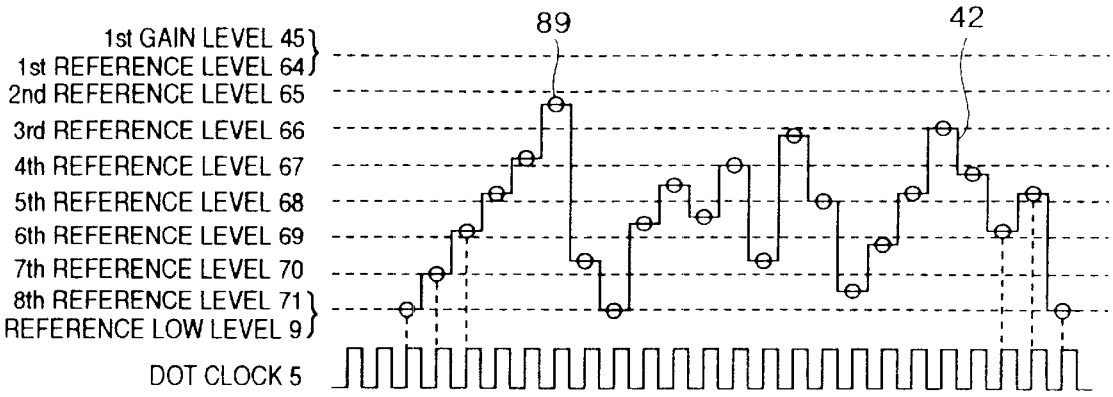
FIG. 18 is a signal timing chart showing operation of the A/D conversion when the gain level exceeds an appropriate gain level.
Figure 19:
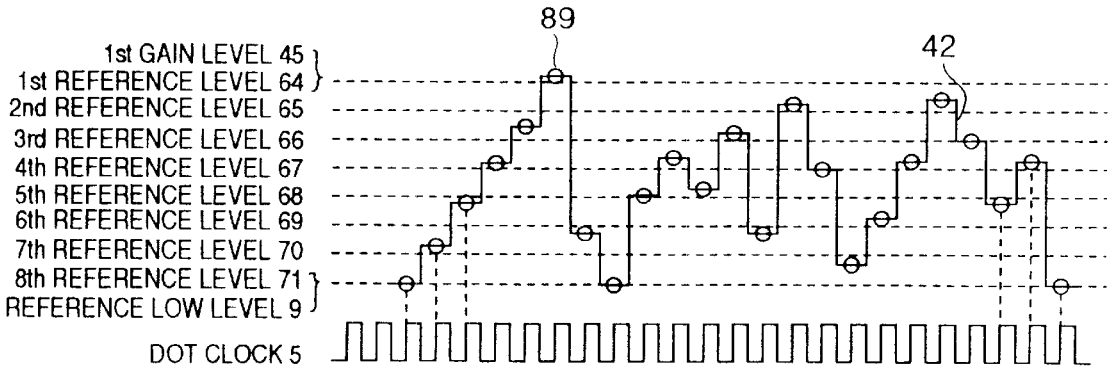
FIG. 19 is a signal timing chart showing operation of the A/D conversion when the gain level is lower than an appropriate gain level.

Description will now be given of: 1. A/D conversion when offset an gain levels are optimally set (FIG. 16); 2. Influence of offset level to results of A/D conversion (FIG. 17); and 3. Influence of gain level to results of A/D conversion (FIGS. 18 and 19). In this connection, for simplification of explanation, the results of A/D conversion includes in this description only the comparator outputs 80 to 87 and the R digital display data 51 shown in FIG. 4.

1. A/D Conversion when Offset an Gain Levels are Optimally Set

Figure 16:
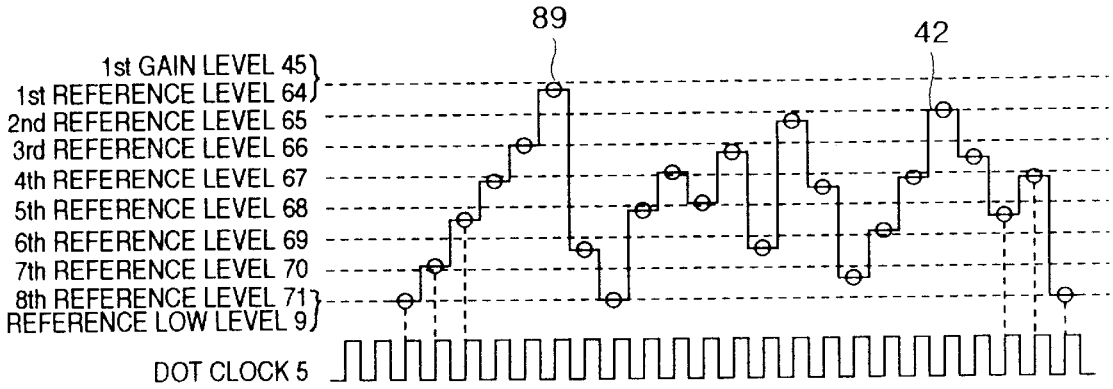
FIG. 16 is a signal timing chart showing operation of the A/D conversion with appropriate offset and gain levels.

FIG. 16 shows the results of A/D conversion (comparator outputs 80 to 87 and R digital display data 51) when the offset and gain levels are appropriately set. Incidentally, FIG. 16 is substantially equal to FIG. 5. The sample point 89 of the A/D conversion designates timing at which the comparators 72 to 79 conduct the voltage comparison. In this case, the point 89 is set to timing of the rising edge of the dot clock 5.

Table 6 shows the first to eighth comparator outputs 80 to 87 at each sample point 89 and Table 7 shows the outputs (i.e., values of R digital display data 51) from the encoder 88 respectively for the first to eighth comparator outputs 80 to 87 of Table 6. The conversion is appropriately achieved in a range from "1,1,1" designating the highest luminance to "0,0,0" representing the lowest luminance. It is to be appreciated that the overflow bit is "0" for each sample point, namely, is correctly converted.

TABLE 6

| | | | | | | | | | | | | | | | | | | | | | | | |
|---|---|---|---|---|---|---|---|---|---|---|---|---|---|---|---|---|---|---|---|---|---|---|---|
| 1st comparator output 80 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 2nd comparator output 81 | 0 | 0 | 0 | 0 | 0 | 1 | 0 | 0 | 0 | 0 | 0 | 0 | 0 | 0 | 0 | 0 | 0 | 0 | 1 | 0 | 0 | 0 | 0 |
| 3rd comparator output 82 | 0 | 0 | 0 | 0 | 1 | 1 | 0 | 0 | 0 | 0 | 0 | 0 | 0 | 1 | 0 | 0 | 0 | 0 | 1 | 0 | 0 | 0 | 0 |
| 4th comparator output 83 | 0 | 0 | 0 | 0 | 1 | 1 | 0 | 0 | 0 | 1 | 0 | 1 | 0 | 1 | 0 | 0 | 0 | 0 | 1 | 1 | 0 | 0 | 0 |
| 5th comparator output 84 | 0 | 0 | 0 | 1 | 1 | 1 | 0 | 0 | 0 | 1 | 1 | 1 | 0 | 1 | 1 | 0 | 0 | 1 | 1 | 1 | 0 | 1 | 0 |
| 6th comparator output 85 | 0 | 0 | 1 | 1 | 1 | 1 | 0 | 0 | 1 | 1 | 1 | 1 | 0 | 1 | 1 | 0 | 1 | 1 | 1 | 1 | 1 | 1 | 0 |
| 7th comparator output 86 | 0 | 1 | 1 | 1 | 1 | 1 | 1 | 0 | 1 | 1 | 1 | 1 | 1 | 1 | 1 | 0 | 1 | 1 | 1 | 1 | 1 | 1 | 0 |
| 8th comparator output 87 | 0 | 1 | 1 | 1 | 1 | 1 | 1 | 0 | 1 | 1 | 1 | 1 | 1 | 1 | 1 | 1 | 1 | 1 | 1 | 1 | 1 | 1 | 0 |

TABLE 7

| | | | | | | | | | | | | | | | | | | | | | | | | |
|---|---|---|---|---|---|---|---|---|---|---|---|---|---|---|---|---|---|---|---|---|---|---|---|---|
| R Digital display data (encoder output) | Overflow | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| | Higher bit | 0 | 0 | 0 | 1 | 1 | 1 | 0 | 0 | 0 | 1 | 1 | 1 | 0 | 1 | 1 | 0 | 0 | 1 | 1 | 1 | 0 | 1 | 0 |
| | ↕ | 0 | 1 | 1 | 0 | 1 | 1 | 1 | 0 | 1 | 0 | 0 | 0 | 1 | 1 | 0 | 0 | 1 | 0 | 1 | 0 | 1 | 0 | 0 |
| | Lower bit | 0 | 0 | 1 | 0 | 0 | 1 | 0 | 0 | 1 | 1 | 0 | 1 | 0 | 0 | 0 | 1 | 1 | 0 | 1 | 1 | 1 | 0 | 0 |

Table 6 is substantially identical to Table 2. Furthermore, the minimum value "0,0,0" (first column) of Table 7 is related to the minimum data 214 outputted from the minimum value storing section 212, and the maximum value "1,1,1,1" (sixth column) of Table 7 is associated with the maximum data 215 outputted from the maximum value storing section 213. In the automatic offset and gain adjusting operations, these data items are the maximum and minimum values during one display period of time.

2. Influence of Offset Level on Results of A/D Conversion

Figure 17:
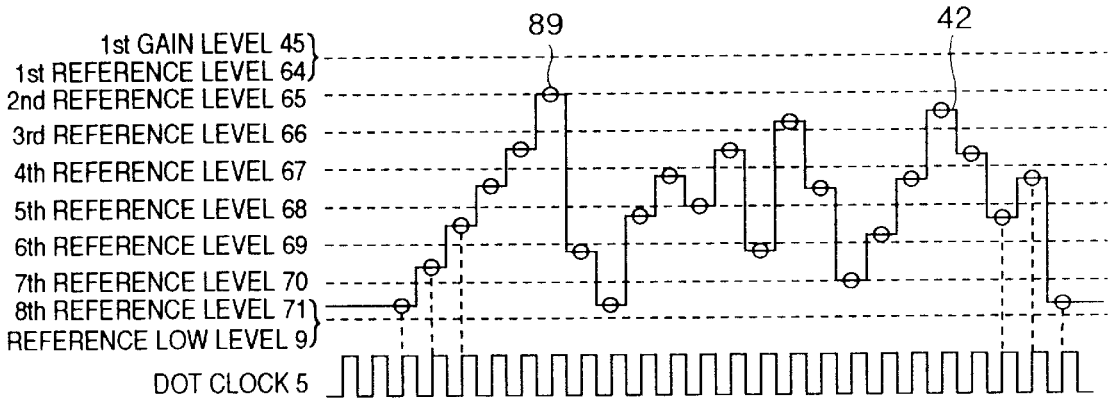
FIG. 17 is a signal timing chart showing operation of the A/D conversion when the offset level exceeds an appropriate offset level.

FIG. 17 shows the digital conversion when the offset value is set to be higher as compared with that shown in FIG. 16. In FIG. 17, for the R analog data 42 for the digital conversion, the first offset level is set to be higher than that of the example of FIG. 16 and the black level of the analog display data exceeds the reference low level 9 in the A/D conversion.

Table 8 shows the first to eight comparator outputs 80 to 87 at each sample point 89 in FIG. 17. The operation of each comparator is as described with reference to Tables 3 and 6. In Table 8, due to the variation in the relative level of the R analog display data 42, the outputs at several sample points 89 are different from those of Table 6. For example, while the comparator output of each comparator is "0" at the first sample point 90 in Table 6, the eighth comparator output is "1" in Table 8.

Table 9 shows the outputs from the encoder 51, i.e., the values of digital display data for the first to eighth comparator outputs 80 to 87 of Table 8. The operation of the encoder 88 is as described above by referring to Tables 3 and 7.

At a sample point where the comparator value varies between Tables 8 and 6, the value of digital data varies between Table 9 and 7. Particularly, the minimum value is "0,0,0" (first column) in Table 7; whereas, the minimum value is "0,0,1" (first column) in Table 9. It is namely indicated that the black display becomes slightly brighter because the offset level is too high. In this case, the offset level is required to be adjusted.

3. Influence of Gain Level on Results of A/D Conversion

First, the case in which the gain level is too high will be described by using FIG. 18.

FIG. 18 shows the digital conversion when the gain value is set to be higher as compared with that shown in FIG. 16. In FIG. 18, the R analog data for digital conversion 42 is the same as that of the example of FIG. 16. However, the R gain level is set to be higher than that of the example of FIG. 16. Moreover, in association therewith, the first to eighth comparison voltages attained by equally dividing the voltage between the R gain level and the reference low level are also different from those of the example of FIG. 16.

Table 10 shows the outputs from the first to eight comparators 72 to 79 at each sample point 89 in FIG. 18. In relation to Table 10, the operation of each comparator is as described above with reference to Tables 2 and 6.

TABLE 8

| | | | | | | | | | | | | | | | | | | | | | | | |
|---|---|---|---|---|---|---|---|---|---|---|---|---|---|---|---|---|---|---|---|---|---|---|---|
| 1st comparator output 80 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 2nd comparator output 81 | 0 | 0 | 0 | 0 | 0 | 1 | 0 | 0 | 0 | 0 | 0 | 0 | 0 | 0 | 0 | 0 | 0 | 0 | 0 | 0 | 0 | 0 | 0 |
| 3rd comparator output 82 | 0 | 0 | 0 | 0 | 0 | 1 | 0 | 0 | 0 | 0 | 0 | 0 | 0 | 1 | 0 | 0 | 0 | 0 | 1 | 0 | 0 | 0 | 0 |
| 4th comparator output 83 | 0 | 0 | 0 | 0 | 1 | 1 | 0 | 0 | 0 | 0 | 0 | 1 | 0 | 1 | 0 | 0 | 0 | 0 | 1 | 1 | 0 | 0 | 0 |
| 5th comparator output 84 | 0 | 0 | 0 | 1 | 1 | 1 | 0 | 0 | 0 | 1 | 0 | 1 | 0 | 1 | 1 | 0 | 0 | 1 | 1 | 1 | 0 | 1 | 0 |
| 6th comparator output 85 | 0 | 0 | 1 | 1 | 1 | 1 | 0 | 0 | 1 | 1 | 1 | 1 | 0 | 1 | 1 | 0 | 1 | 1 | 1 | 1 | 1 | 1 | 0 |
| 7th comparator output 86 | 0 | 1 | 1 | 1 | 1 | 1 | 1 | 0 | 1 | 1 | 1 | 1 | 1 | 1 | 1 | 0 | 1 | 1 | 1 | 1 | 1 | 1 | 0 |
| 8th comparator output 87 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |

TABLE 9

| | | | | | | | | | | | | | | | | | | | | | | | | |
|---|---|---|---|---|---|---|---|---|---|---|---|---|---|---|---|---|---|---|---|---|---|---|---|---|
| R Digital display data (encoder output) | Overflow | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| | Higher bit | 0 | 0 | 0 | 1 | 1 | 1 | 0 | 0 | 0 | 1 | 0 | 1 | 0 | 1 | 1 | 0 | 0 | 1 | 1 | 1 | 0 | 1 | 0 |
| | ↕ | 0 | 1 | 1 | 0 | 0 | 1 | 1 | 0 | 1 | 0 | 1 | 0 | 1 | 1 | 0 | 0 | 1 | 0 | 1 | 0 | 1 | 0 | 0 |
| | Lower bit | 1 | 0 | 1 | 0 | 1 | 1 | 0 | 1 | 1 | 0 | 1 | 1 | 0 | 0 | 0 | 1 | 1 | 0 | 0 | 1 | 1 | 0 | 1 |

TABLE 10

| | | | | | | | | | | | | | | | | | | | | | | |
|---|---|---|---|---|---|---|---|---|---|---|---|---|---|---|---|---|---|---|---|---|---|---|
| 1st comparator output 80 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 2nd comparator output 81 | 0 | 0 | 0 | 0 | 0 | 1 | 0 | 0 | 0 | 0 | 0 | 0 | 0 | 0 | 0 | 0 | 0 | 0 | 0 | 0 | 0 | 0 |
| 3rd comparator output 82 | 0 | 0 | 0 | 0 | 0 | 1 | 0 | 0 | 0 | 0 | 0 | 0 | 0 | 0 | 0 | 0 | 0 | 0 | 1 | 0 | 0 | 0 |
| 4th comparator output 83 | 0 | 0 | 0 | 0 | 1 | 1 | 0 | 0 | 0 | 0 | 0 | 0 | 0 | 1 | 0 | 0 | 0 | 0 | 1 | 0 | 0 | 0 |
| 5th comparator output 84 | 0 | 0 | 0 | 1 | 1 | 1 | 0 | 0 | 0 | 1 | 0 | 1 | 0 | 1 | 0 | 0 | 0 | 1 | 1 | 1 | 0 | 1 |
| 6th comparator output 85 | 0 | 0 | 1 | 1 | 1 | 1 | 0 | 0 | 1 | 1 | 1 | 1 | 0 | 1 | 1 | 0 | 0 | 1 | 1 | 1 | 1 | 1 |
| 7th comparator output 86 | 0 | 0 | 1 | 1 | 1 | 1 | 1 | 0 | 1 | 1 | 1 | 1 | 1 | 1 | 1 | 0 | 1 | 1 | 1 | 1 | 1 | 1 |
| 8th comparator output 87 | 0 | 1 | 1 | 1 | 1 | 1 | 1 | 0 | 1 | 1 | 1 | 1 | 1 | 1 | 1 | 1 | 1 | 1 | 1 | 1 | 1 | 1 |

TABLE 11

| | | | | | | | | | | | | | | | | | | | | | | | | |
|---|---|---|---|---|---|---|---|---|---|---|---|---|---|---|---|---|---|---|---|---|---|---|---|---|
| R Digital display data (encoder output) | Overflow | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| | Higher bit | 0 | 0 | 0 | 1 | 1 | 1 | 0 | 0 | 0 | 1 | 0 | 1 | 0 | 1 | 0 | 0 | 0 | 1 | 1 | 1 | 0 | 1 | 0 |
| | ↕ | 0 | 1 | 1 | 0 | 0 | 1 | 1 | 0 | 1 | 0 | 1 | 0 | 1 | 0 | 1 | 0 | 1 | 0 | 1 | 0 | 1 | 0 | 0 |
| | Lower bit | 0 | 1 | 1 | 0 | 1 | 0 | 0 | 0 | 1 | 0 | 1 | 0 | 0 | 1 | 1 | 1 | 0 | 0 | 0 | 0 | 1 | 0 | 0 |

Because of the variation in the reference voltage level, the outputs at several points vary from those shown in Table 6. For example, while only the first comparator output is "0" at the sixth sample point in Table 6, the first and second comparator outputs are "0" in Table 10.

Table 11 shows the outputs from the encoder 88, i.e., the values of the digital display data for the first to eighth comparator outputs 80 to 87 of Table 10. The operation of the encoder 88 is as described above in conjunction with Tables 3 and 7. When compares with FIG. 16, the digital data also takes different values at sample points where the comparator output takes different values. Particularly, the maximum value is "0,1,1,1" (sixth column) in Table 7; whereas, the maximum value is "0,1,1,1" (sixth column) in Table 11. This accordingly indicates that the white display becomes slightly darker. In this case, the gain level is required to be adjusted. The sample point is a reference to determine whether or not the gain level is too high.

The case in which the gain level is too low will be described by referring to FIG. 14.

FIG. 19 shows the digital conversion when the gain value is set to be lower as compared with that shown in FIG. 16. The R analog data for digital conversion 42 is the same as that of FIG. 16. However, the R gain level is set to be lower than that of the example of FIG. 16. In association therewith, the first to eighth comparison voltages 64 to 71 attained by equally dividing the voltage between the R gain level and the reference low level are also different from those of FIG. 16.

Table 11 shows the outputs from the first to eight comparators 72 to 79 at each sample point 89 in FIG. 19. The operation of each comparator is as described above by referring to Tables 2 and 6. Because of the variation in the reference voltage level, the outputs at several points in Table 11 vary from those of Table 6. For example, while only the first comparator output is "0" at the sixth sample point in Table 6, all comparator outputs are "0" in Table 11.

TABLE 12

| | | | | | | | | | | | | | | | | | | | | | | | | |
|---|---|---|---|---|---|---|---|---|---|---|---|---|---|---|---|---|---|---|---|---|---|---|---|---|
| 1st comparator output 80 | 0 | 0 | 0 | 0 | 0 | 1 | 0 | 0 | 0 | 0 | 0 | 0 | 0 | 0 | 0 | 0 | 0 | 0 | 0 | 0 | 0 | 0 | 0 | 0 |
| 2nd comparator output 81 | 0 | 0 | 0 | 0 | 0 | 1 | 0 | 0 | 0 | 0 | 0 | 0 | 0 | 0 | 0 | 0 | 0 | 0 | 1 | 0 | 0 | 0 | 0 | 0 |
| 3rd comparator output 82 | 0 | 0 | 0 | 0 | 1 | 1 | 0 | 0 | 0 | 0 | 0 | 1 | 0 | 1 | 0 | 0 | 0 | 0 | 1 | 0 | 0 | 0 | 0 | 0 |
| 4th comparator output 83 | 0 | 0 | 0 | 1 | 1 | 1 | 0 | 0 | 0 | 1 | 0 | 1 | 0 | 1 | 0 | 0 | 0 | 1 | 1 | 1 | 0 | 1 | 0 | 0 |
| 5th comparator output 84 | 0 | 0 | 0 | 1 | 1 | 1 | 0 | 0 | 1 | 1 | 1 | 1 | 0 | 1 | 1 | 0 | 0 | 1 | 1 | 1 | 0 | 1 | 0 | 0 |
| 6th comparator output 85 | 0 | 0 | 1 | 1 | 1 | 1 | 0 | 0 | 1 | 1 | 1 | 1 | 0 | 1 | 1 | 0 | 1 | 1 | 1 | 1 | 1 | 1 | 0 | 0 |
| 7th comparator output 86 | 0 | 1 | 1 | 1 | 1 | 1 | 1 | 0 | 1 | 1 | 1 | 1 | 1 | 1 | 1 | 0 | 1 | 1 | 1 | 1 | 1 | 1 | 0 | 0 |
| 8th comparator output 87 | 0 | 1 | 1 | 1 | 1 | 1 | 1 | 0 | 1 | 1 | 1 | 1 | 1 | 1 | 1 | 1 | 1 | 1 | 1 | 1 | 1 | 1 | 0 | 0 |

TABLE 13

| | | | | | | | | | | | | | | | | | | | | | | | | |
|---|---|---|---|---|---|---|---|---|---|---|---|---|---|---|---|---|---|---|---|---|---|---|---|---|
| R Digital display data (encoder output) | Overflow | 0 | 0 | 0 | 0 | 0 | 1 | 0 | 0 | 0 | 0 | 0 | 0 | 0 | 0 | 0 | 0 | 0 | 0 | 0 | 0 | 0 | 0 | 0 |
| | Higher bit | 0 | 0 | 0 | 1 | 1 | 1 | 0 | 0 | 1 | 1 | 1 | 1 | 0 | 1 | 1 | 0 | 0 | 1 | 1 | 1 | 0 | 1 | 0 |
| | ↕ | 0 | 1 | 1 | 0 | 1 | 1 | 1 | 0 | 0 | 0 | 0 | 1 | 1 | 1 | 0 | 0 | 1 | 0 | 1 | 0 | 1 | 0 | 0 |
| | Lower bit | 0 | 0 | 1 | 1 | 0 | 1 | 0 | 0 | 0 | 1 | 0 | 0 | 0 | 1 | 0 | 1 | 1 | 1 | 1 | 1 | 1 | 1 | 0 |

Table 13 shows the outputs from the encoder 88, i.e., the values of the digital display data for the first to eighth comparator outputs 80 to 87 of Table 12. The operation of the encoder 88 is as described above by referring to Tables 3 and 7. When compares with FIG. 16, the digital data also takes different values at sample points where the comparator output takes different values. Particularly, the maximum value is "0,1,1,1" (sixth column) in Table 7; whereas, the maximum value is "1,1,1,1" (sixth column) in Table 12. In other words, it is indicated that the white display as well as a grey display slightly darker than white at the 19th sample point become the white display. In this case, the gain level is also required to be adjusted. These sample points are references to determine whether or not the gain level is too low.

Subsequently, description will be given of the automatic offset level adjustment in the embodiment.

As already described, the automatic offset level adjustment itself is accomplished by the A/D converting section 10 described above. However, an operation to "automatically" conduct the adjustment process by appropriately altering the offset level 207 is conducted by the automatic offset adjusting section 216.

Figure 20:
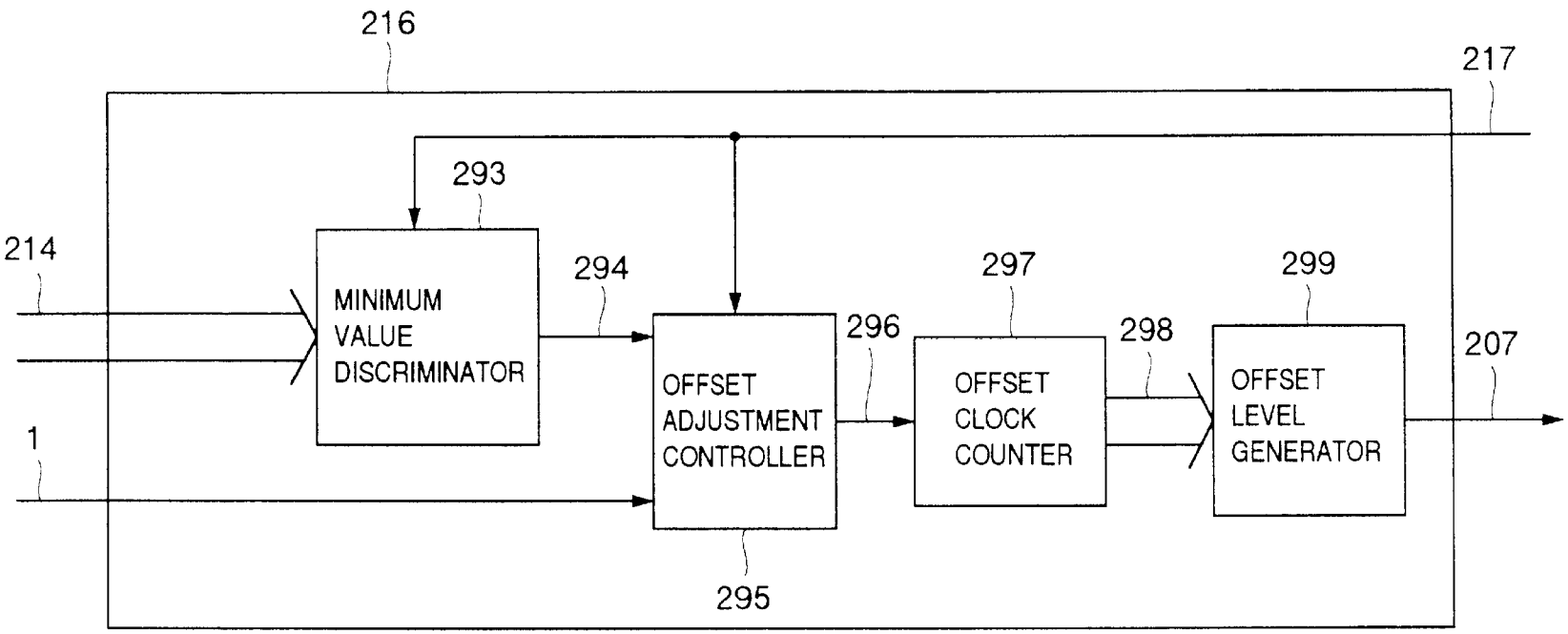
FIG. 20 is a block diagram showing an example of constitution of an automatic offset adjusting section of FIG. 15.

First, the configuration of the automatic offset adjusting section 216 will be described by referring to FIG. 20.

The adjusting section 216 includes a minimum value discriminator 293, an offset adjustment controller 295, an off set clock counter 297, and an offset level generator 299.

The minimum value discriminator 293 discriminates minimum value data 214 before/after offset adjustment to generate a discrimination output 294. It is assumed in this embodiment that the data 214 includes a total of four bits including one bit indicating an overflow and three bits representing display data. When the minimum value data 214 is altered from a state other than "0,0,0" to the state of "0,0,0", the discriminator 293 outputs "1" as the discrimination output 294.

During the period in which the automatic offset adjustment is achieved, the offset adjustment controller 295 generates an offset adjustment control signal 296. The controller 295 decides the start point of the offset level adjustment according to a "1" pulse of the offset adjustment start signal 217. On the other hand, the controller 295 determines the end point thereof according to the minimum value discrimination output 294.

The offset clock counter 297 outputs, when the system is powered, an initial value beforehand set and then generates a count output 298 according to the offset adjustment clock 296.

The offset level generator 299 outputs analog data according to the value of the count output 298 from the counter 297, the data being in the form of an offset level 207. The generator 299 is a member having a function to convert a digital value into an analog value and hence may be configured with a D/A converter or with digital variable resistors to divide a reference voltage.

Operation of the automatic offset adjusting section 216 will be described with reference to FIGS. 20 and 21.

The offset clock counter 297 outputs a certain initial value when the power is turned on. In this state, the initial value decides that of the offset level 207 (step 1600).

The offset adjustment controller 295 monitors the offset adjustment start signal 217 to decide the automatic adjustment start point. When the start point is thereafter detected, the controller 295 initiates the automatic adjustment.

During the automatic adjustment, the minimum value discriminator 293 discriminates whether or not the minimum value data 214 is "0,0,0" and outputs the result of discrimination as a discrimination output 294 to the offset adjustment controller 295 (steps 1602, 1604).

As a result of the discrimination, if the data 214 is "0,0,0", the offset level is appropriate or too low. To avoid an event that the offset level is too low, the controller 295 supplies an offset adjustment control signal 296 to the offset clock counter 297 to raise the offset level 207 (step 1606). That is, the counter 297 is caused to increase the count thereof. The offset level generator 299 create an analog value according to the value of the count output 298 and outputs the value as an offset level 207. Thereafter, control is again transferred to step 1602.

Until the data 214 becomes "0,0,0" (i.e., the offset level 207 is higher than the level of minimum value data 214) as a result of the operation above, the automatic offset adjusting section 216 repeatedly conducts the process ranging from step 1602 to step 1606. In this case, the increase of the count is achieved in synchronism with the vertical synchronization signal 1, the count output 298 and the offset level 207 are raised in level for each display period.

In step 1604, when the data 214 is other than "0,0,0", control proceeds to step 1608.

In step 1608, the controller 295 controls the offset clock counter 297 by the control signal 296 to reduce the offset level. Namely, the count of the counter 297 is decremented. The offset level generator 299 produces an analog value according to the value of the count output 298 from the counter 297 and outputs the value as an offset level 207.

The minimum value discriminator 293 discriminates whether or not the data 214 is "0,0,0" in step 1610 as in the step 1604. When the data 214 is "0,0,0" as a result of the discrimination, the discriminator 293 outputs "1" as the discrimination output 294.

When "1" is outputted as the discrimination output 294, the controller 295 terminates the automatic offset adjustment.

In this connection, the offset level 207 is once set to exceed 0 in this embodiment (reference is to be made to steps 1604 and 1606) to avoid an event in which the offset level is too low.

Subsequently, description will be given in more detail of the operation of the automatic offset adjusting section 216 in which the operation is classified according to the magnitude of each offset level.

First, referring to FIG. 22, description will be given in detail of the operation of the automatic offset adjusting section 216 in which the initial value of the offset level is too large. In this regard, an item indicated by reference numeral 300 is black level analog data as the minimum value data.

A first offset adjustment duration 301 begins at a display period subsequent to the display period in which the offset adjustment start signal 217 is inputted. In the first duration 301, the offset level is set according to the initial value set to the counter 297.

Figure 22:
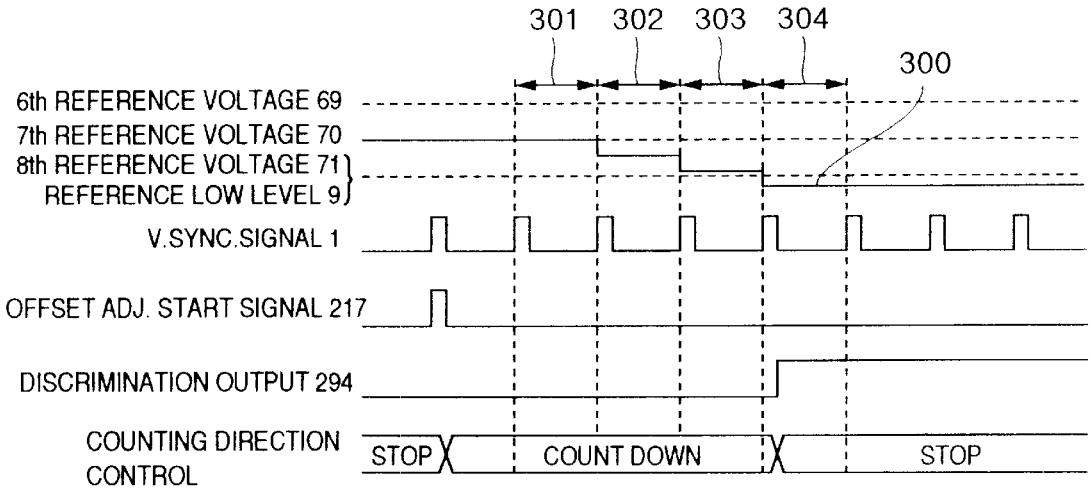
FIG. 22 is a graph showing operation of the automatic offset adjustment when the offset level exceeds an appropriate offset level.

In the example of FIG. 22, the minimum value data is not "0,0,0". Namely, the the reference low level is exceeded and it is indicated that the initial value is too large. Therefore, to decrease the offset level, the controller 295 outputs the control signal 296 to effect the count decrement control operation (step 1608 of FIG. 16). The control operation is continuously achieved until the minimum value data 214 becomes "0,0,0" (steps 1608 and 1610 of FIG. 16). In other words, the count decrement control is thereafter carried out also in the second to fourth offset adjustment durations 302 to 304 in a similar fashion to sequentially minimize the offset level.

The smaller the step of decrement of the offset level is, the higher the adjustment precision is. The step is required to be less than (higher reference voltage (65 of FIG. 4) of A/D converter−lower reference voltage (71 of FIG. 4) of thereof)/(resolution−1). The step is established by the synchronous offset generating section 99.

When the data 214 is changed from "0,0,1" to "0,0,0" during the fourth offset adjustment duration 304, the discrimination output 294 becomes "1". In response thereto, the controller 295 outputs the control signal 296 to stop the counter beginning at the next display period. The automatic offset level adjustment is then terminated.

Next, description will be given in detail of the operation of the automatic offset adjusting section 216 when the initial value of the offset level is small.

The first offset adjustment duration 301 begins at a display period subsequent to the display period in which the offset adjustment start signal 217 is inputted. In the first duration 301, the offset level is set according to the initial value set to the counter 297.

Figure 23:
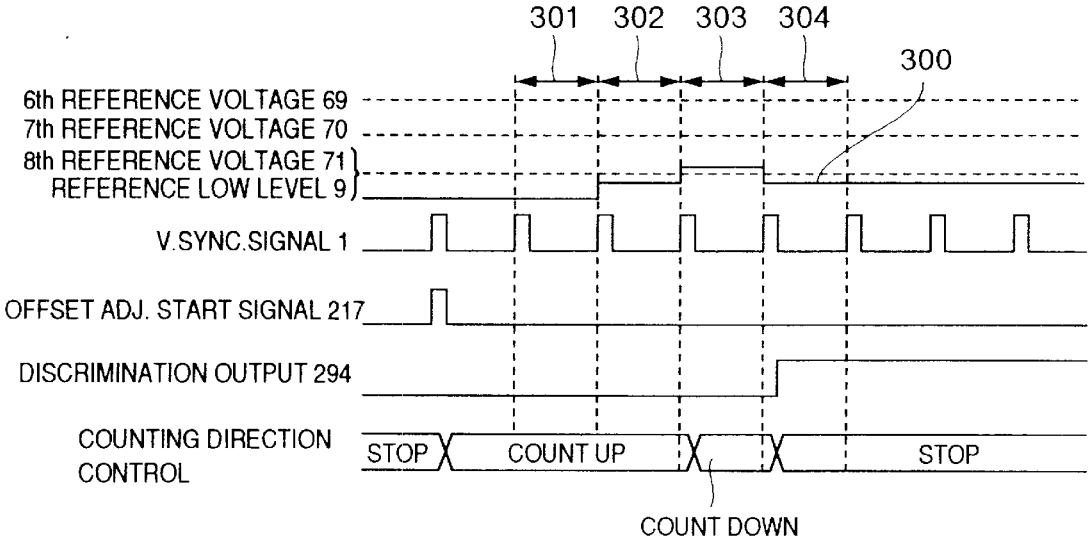
FIG. 23 is a graph showing operation of the automatic offset adjustment when the offset level is below an appropriate offset level.

In the example of FIG. 23, the minimum value data 214 is "0,0,0", which indicates that the initial value is too small or appropriate. Therefore, assuming that the initial value is too small, the controller 295 achieves the count increment control to raise the offset level.

Figure 21:
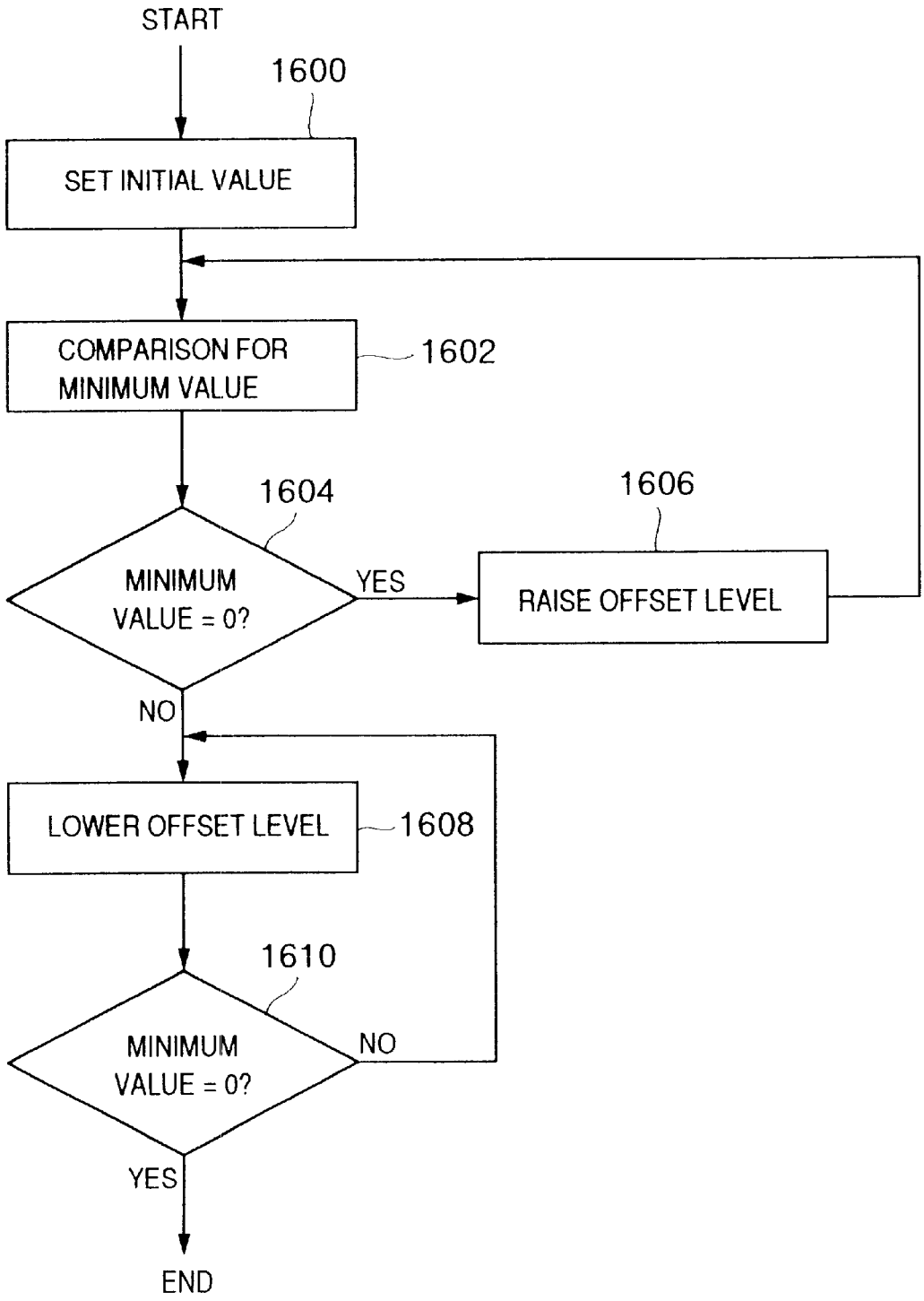
FIG. 21 is a flowchart showing operation of the automatic offset adjusting section of FIG. 20.

The control operation is continuously accomplished until the data 214 becomes "0,0,1" (steps 1602, 1604, and 1606 of FIG. 21). Namely, the control operation is thereafter similarly accomplished also in the second offset adjustment period 302 to sequentially increase the offset level.

When the data 214 becomes "0,0,1" in the third offset adjustment period 303, the controller 295 switch its operation to the count decrement control to lower the offset level 217. The control operation is continuously conducted, as in the case of FIG. 22, until the data 214 becomes "0,0,0" (steps 1608 and 1610 of FIG. 16).

When the data 214 alters from "0,0,1" to "0,0,0" in the fourth offset adjustment period 304, the minimum value discrimination output 294 becomes "1". In response thereto, controller 295 conducts count stop control operation beginning at the next display period. The automatic offset level adjustment is thereby terminated.

The smaller the step to increment/decrement the offset level is, the higher the adjustment precision is. The step is required to be less than (higher reference voltage (65 of FIG. 4) of A/D converter−lower reference voltage (71 of FIG. 4) thereof/(resolution−1). The setting of the step is accomplished by the offset level generator 299.

Next description will be given of the gain level adjustment in this embodiment.

As already described, the process of adjustment of the gain level 208 is conducted by the A/D converting section 10 described above. However, an operation to "automatically" conduct the adjustment process by appropriately altering the gain level 208 is conducted by the automatic gain level adjusting section 218.

Figure 24:
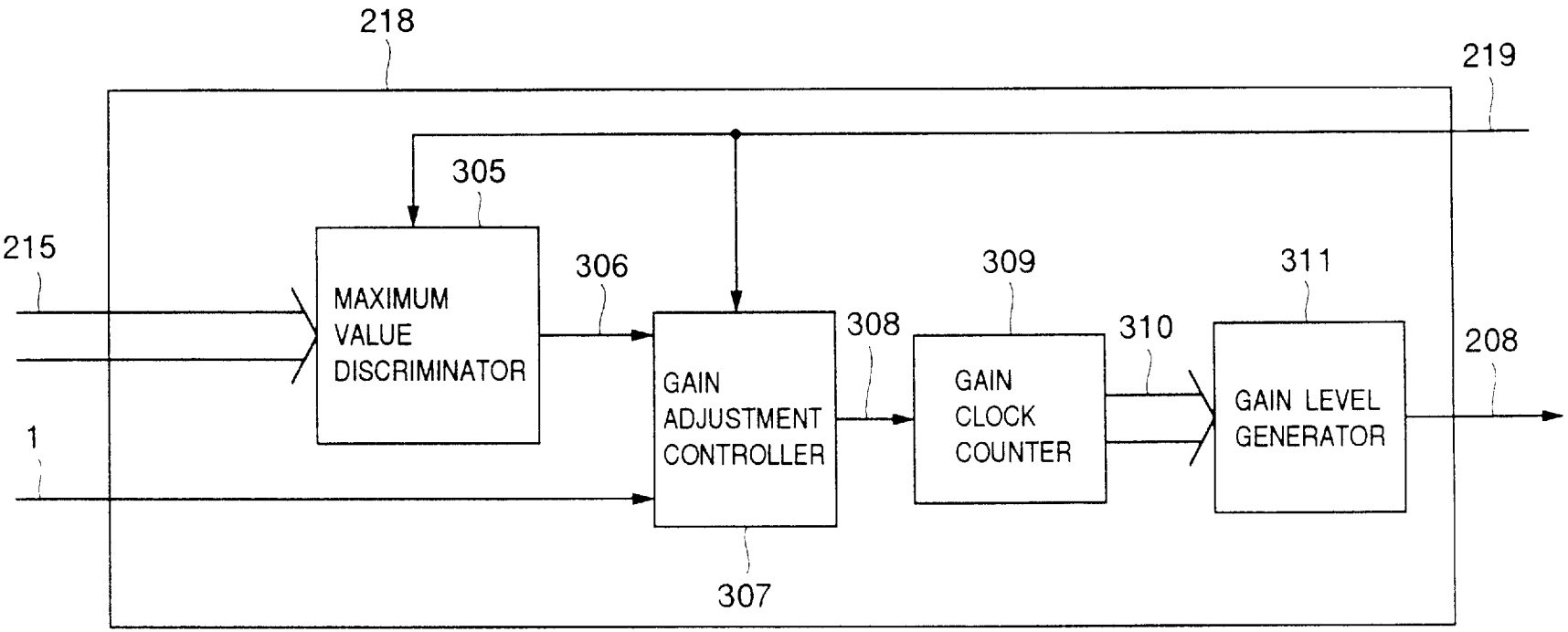
FIG. 24 is a block diagram showing an example of constitution of an automatic gain adjusting section of FIG. 20.

First, the configuration of the automatic offset adjusting section 218 will be described by referring to FIG. 24.

The adjusting section 218 includes a maximum value discriminator 305, a gain adjustment controller 307, a gain clock counter 309, and a gain level generator 311.

The maximum value discriminator 305 discriminates maximum value data 215 to generate a discrimination output 306. It is assumed in this embodiment that the data 215 includes a total of four bits including one bit indicating an overflow and three bits representing display data. When the maximum value data 215 is altered from a state of "1,1,1" to a state other than "1,1,1", the discriminator 305 of the embodiment outputs "1" as the discrimination output 306.

During the period in which the automatic gain adjustment is achieved, the gain adjustment controller 307 generates a gain adjustment control signal 308. The controller 307 decides the start point of the gain level adjustment according to a "1" pulse of the gain adjustment start signal 219. On the other hand, the controller 295 determines the end point thereof according to the maximum value discrimination output 306.

Although the discriminator 305 and the controller 307 are separately configured in the embodiment, these components may be constructed in an integral manner. Moreover, these elements may be implemented by hardware or may be realized executing a predetermined program by a microcomputer.

The gain clock counter 309 outputs, when the gain adjustment start signal is inputted, an initial value set at initialization of power. The counter 309 then generates a count output 310 according to the gain adjustment clock 308.

The gain level generator 311 outputs analog data according to the value of the count output 310 from the counter 309, the data being in the form of a gain level 208. The generator 311 converts, line the generator 299 shown in FIG. 20, a digital value into an analog value and hence may be configured with a D/A converter or with digital variable resistors to divide a reference voltage.

Figure 25:
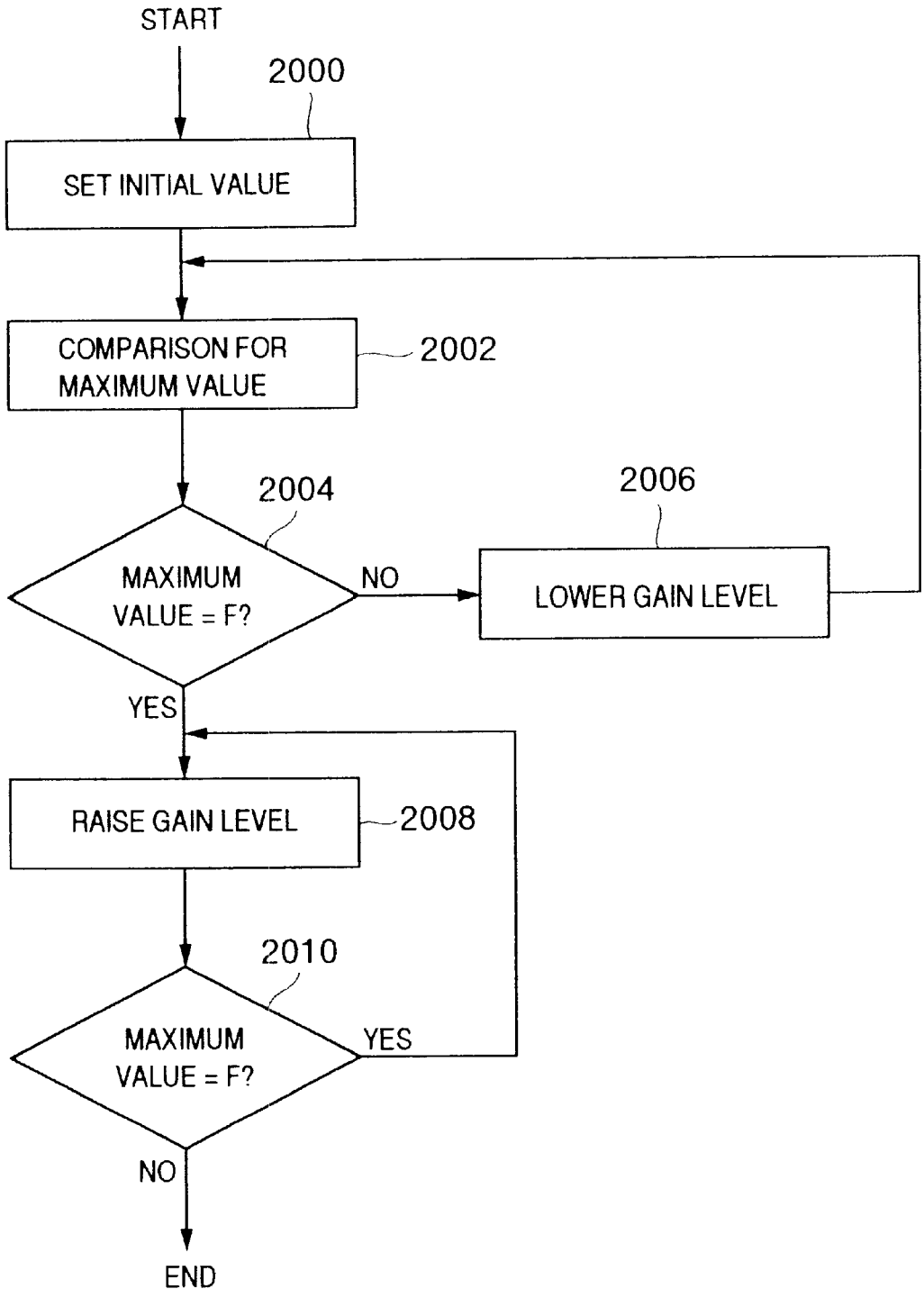
FIG. 25 is a flowchart showing operation of the automatic gain adjusting section of FIG. 24.

Operation of the automatic gain adjusting section 218 will be described with reference to FIGS. 24 and 25.

The gain clock counter 309 outputs a certain initial value when the power is turned on. In this state, the initial value decides that of the gain level 208 (step 2000).

The gain adjustment controller 307 monitors the gain adjustment start signal 219 to decide the automatic adjustment start point. When the start point is thereafter detected, the controller 307 initiates the automatic adjustment.

During the automatic adjustment, the maximum value discriminator 305 discriminates whether or not the maximum value data 215 is "1,1,1,1" ("F" indicated in FIG. 25) and outputs the result of discrimination as a discrimination output 306 to the gain adjustment controller 307 (steps 2002, 2004). In this connection, when the maximum value data 215 is "1,1,1" as a result of discrimination, the discriminator 305 outputs "1" as the discrimination output 306.

As a result of discrimination, if the data 215 is other than "1,1,1,1", the gain level 208 at the point is appropriate or too high. Consequently, to avoid an event that the gain level is too high, the controller 307 supplies a gain adjustment control signal 308 to the gain clock counter 309 to decrease the gain level 208 (step 2006). That is, the counter 309 is caused to decrease the count thereof. The gain level generator 311 creates an analog value according to the value of the count output 310 from the counter 309 and outputs the value as a gain level 208. Thereafter, control is again transferred to step 2002.

Until the data 215 becomes "1,1,1,1" (i.e., the gain level 208 is lower than the level of maximum value data 215) as a result of the operation above, the automatic gain adjusting section 218 repeatedly conducts the process ranging from step 2002 to step 2006. In this case, since the increase of the count is achieved in synchronism with the vertical synchronization signal 1, the count output 310 and the gain level 208 are lowered in level for each display period.

In step 2004, when the data 215 is "1,1,1,1", control is passed to step 2008.

When the maximum value data 215 is "1,1,1,1", the gain level 208 is too low. Consequently, in step 2008, the gain adjustment controller 307 controls the gain clock counter 309 by the control signal 308 to raise the gain level 208. Namely, the count of the counter 309 is incremented. The gain level generator 311 produces an analog value according to the value of the count output 310 from the counter 309 and outputs the value as the gain level 208.

The maximum value discriminator 305 discriminates whether or not the data 215 is "1,1,1,1" in step 2010 as in step 2004. In a period in which the discrimination output "1" is being inputted, namely, the data 215 is "1,1,1,1" control is returned to step 2008 such that the discriminator 307 repeatedly conducts the count increment control operation.

When the maximum value data 215 is other than "1,1,1,1" in step 2010, the gain adjustment controller 307 assumes that the gain level 208 is of a satisfactory magnitude and then terminates the automatic gain adjustment.

In this regard, the gain clock counter 309 conducts the count increment and decrement operations according to the control signal 308. In this embodiment, the vertical synchronization signal 1 is employed as the clock of operations in either cases. Since the synchronization is established according to the vertical synchronization signal 1 in both cases, the count data 310 varies for each display period. Therefore, the gain level 208 changes for each display period.

Description will be given in detail of the operation of the automatic gain adjustment when the gain level 208 has a low initial value by referring to FIG. 26. In the diagram, an item indicated by reference numeral 412 is a level (white level) of maximum luminance display analog data as the maximum data.

The first gain adjustment duration 413 begins at a display period subsequent to the display period in which the gain adjustment start signal 219 is inputted. In the first duration 413, the gain level is set according to the initial value set to the counter 309.

When the initial value is low, the digital display data from the A/D converting section 10, namely, the maximum value data 15 from the maximum value storing section 213 is "1,1,1,1" (reference is to be made to Table 1). Therefore, to raise the gain level 208, the gain adjustment controller 307 effects the count increment control operation. In relation to the adjustment of gain level 208, the first reference voltage 64 is also adjusted. In this manner, the gain level 208 is sequentially increased in the second to fourth gain adjustment periods 414 to 416 (steps 2008 and 2010 of FIG. 25).

The count increment control operation is continuously executed until the maximum value data 215 is other than "1,1,1,1". When the data 215 is changed from "1,1,1,1" to "0,1,1,1" during the fourth gain adjustment duration 416, the discrimination output 306 becomes "1". In response thereto, the controller 307 switches its operation to the count stop control operation beginning at the next display period. The automatic gain level adjustment is then terminated.

The smaller the step of increment of the gain level 208 is, the higher the adjustment precision is. The step is required to be less than (higher reference voltage (64 of FIG. 4) of A/D converter−lower reference voltage (71 of FIG. 4) of thereof)/(resolution−1). The step setting is effected by the gain level generator 311.

Figure 27:
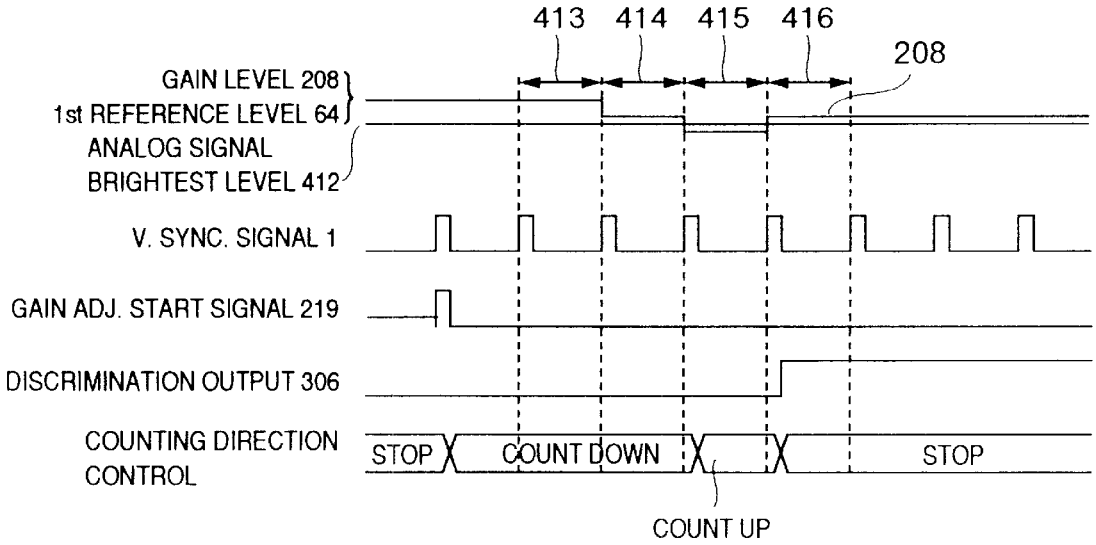
FIG. 27 is a graph showing operation of the automatic gain adjustment when the gain level exceeds an appropriate offset level.

Description will be given in detail of the operation of the automatic gain adjustment when the gain level 208 has a high initial value by referring to FIG. 27.

The first gain adjustment duration 413 begins at a display period subsequent to the display period in which the gain adjustment start signal 219 is inputted. In the first duration 413, the gain level is set according to the initial value set to the counter 309.

When the initial value is high, the digital display data from the A/D converting section 10, namely, the maximum value data 15 from the maximum value storing section 213 is other than "1,1,1,1" (reference is to be made to Table 1). Therefore, to once set the gain level 208 to be lower than the maximum value level 412 of the analog display data, the gain adjustment controller 307 effects the count decrement control operation (step 2006 of FIG. 25). In association with the adjustment of gain level 208, the first reference voltage 64 is also adjusted. In this fashion, the gain level 208 is sequentially decreased in the second and third gain adjustment periods 414 and 415.

The count decrement control operation is continuously executed until the maximum value data 215 becomes "1,1,1,1". When the data 215 becomes "1,1,1,1" during the third gain adjustment duration 415, the discrimination output 306 becomes "1". In response thereto, to increase the gain level 208, the controller 307 switches its operation to the count stop control operation beginning at the subsequent fourth gain adjustment period 416 (steps 2002, 2004, and 2006 of FIG. 25).

Figure 26:
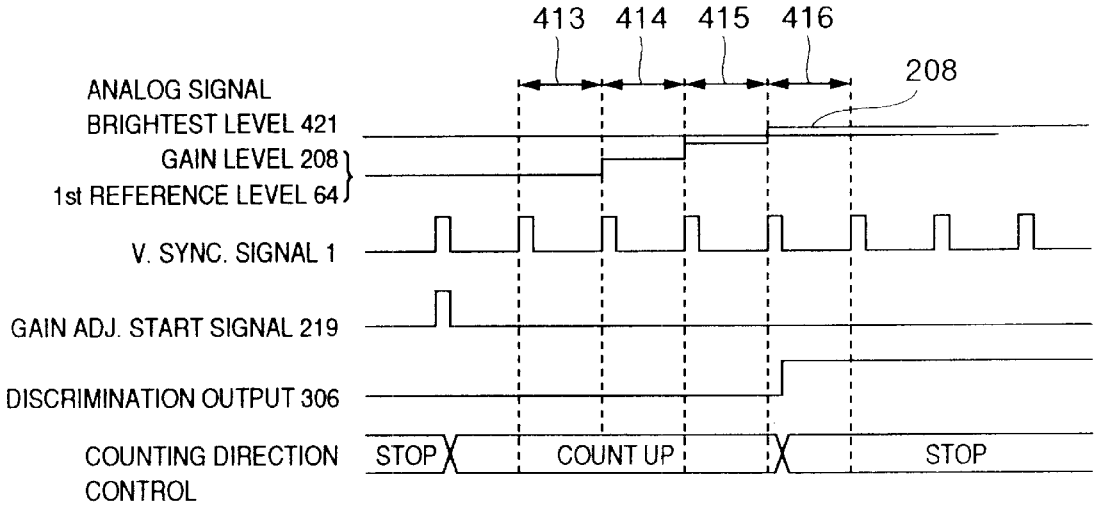
FIG. 26 is a graph showing operation of the automatic gain adjustment when the gain level is below an appropriate offset level.

The control operation is continuously accomplished, like in FIG. 26, until the data 215 becomes other than "1,1,1,1". When the data 215 changes from "1,1,1,1" to "0,1,1,1" during the fourth gain adjustment duration 416, the discrimination output 306 also becomes "1". In response thereto, the controller 307 switches its operation to the count stop control operation to terminate the automatic gain level adjustment.

Also in this case, the smaller the step of increment/decrement of the gain level is, the higher the adjustment precision is. The step is required to be less than (higher reference voltage (65 of FIG. 4) of A/D converter−lower reference voltage (71 of FIG. 4) of thereof)/(resolution−1). The setting operation is carried out by the gain level generator 311.

According to the third embodiment described above, the offset and gain levels can be automatically adjusted.

The present invention is applicable to the liquid crystal display apparatuses as well as various kinds of matrix display apparatuses.

In accordance with the embodiment, since the digital display data undergone the analog-to-digital conversion is read out to be displayed on the LC panel in the overlay display mode, it is possible to appropriately adjust the color while visually checking the displayed values.

Since the maximum and minimum values of the digital display data undergone the analog-to-digital conversion is read out such that the offset and gain levels thereof are adjusted in synchronism with the vertical synchronization signal, it is possible to automatically attain optimal offset and gain levels. Additionally, since the maximum and minimum values of one display period are read out, the automatic adjustment can be accomplished on the display screen in the status in which the personal computer is ordinarily utilized.

Embodiment 4

The fourth embodiment of the liquid crystal (LC) display apparatus according to the present invention also has an aspect of the automatic offset and gain adjustment.

Figure 28:
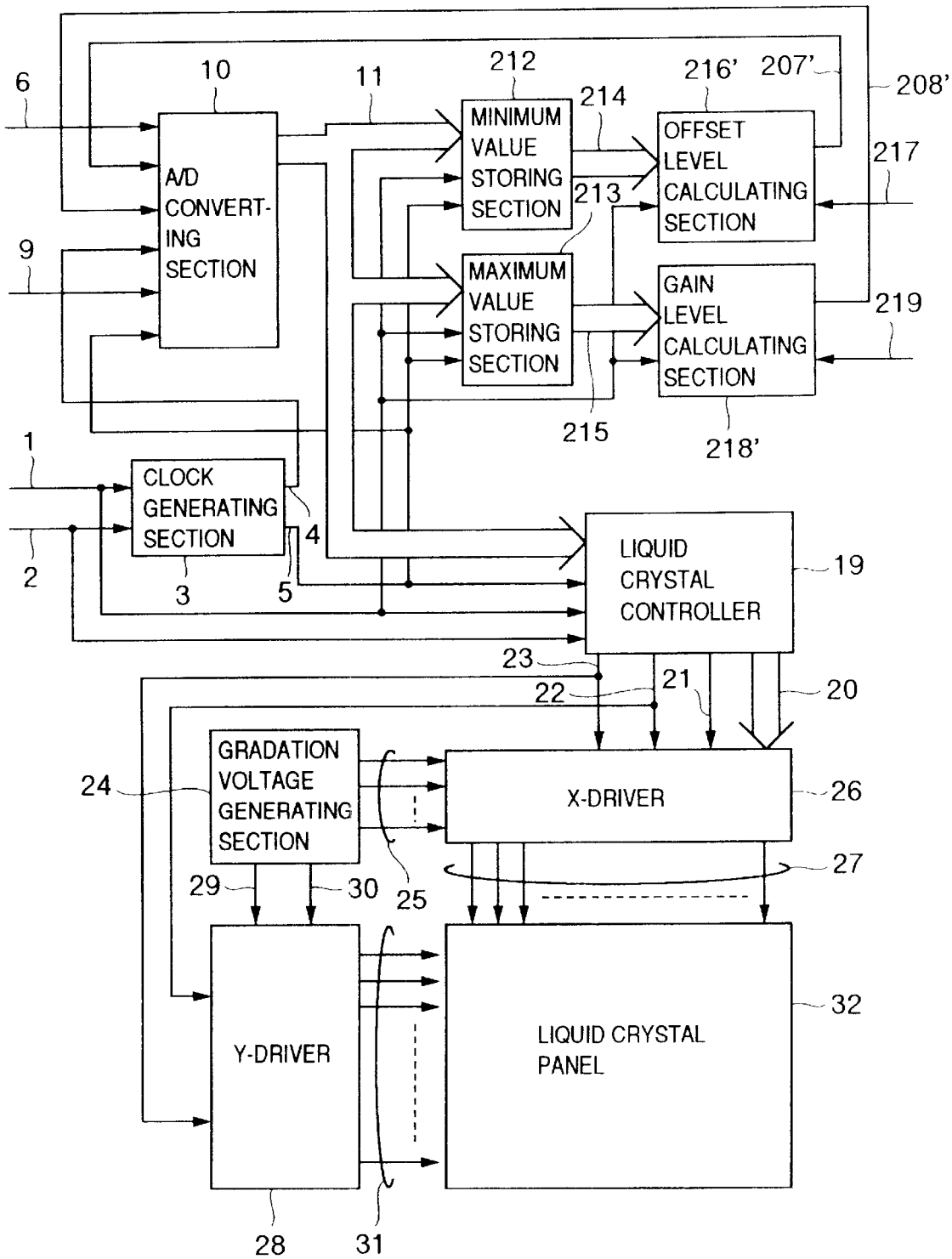
FIG. 28 is a block diagram showing an analog interface liquid crystal display apparatus in an embodiment according to the present invention.

First, an outline of the LC display apparatus will be described with reference to FIG. 28.

The display apparatus includes a clock generating section 3, an A/D converting section 10, a minimum value storing section 212, a maximum value storing section 213, an offset level calculating section 216', a gain level calculating section 218', an LC controller 19, a gradation voltage venerating section 24, an X-driver 26, a Y-driver 28, and a LC panel 32.

The clock generator 3, A/D converting section 10, minimum value storing section 212, maximum value storing section 213, LC controller 19, gradation voltage venerating section 24, X-driver 26, Y-driver 28, and LC panel 32 are similar to those of the third embodiment.

The offset level calculating section 216' creates an offset level 207' to adjust the offset in the A/D converting section 10. The calculating section 216' outputs a certain initial value for the offset level 207'. However, when an offset adjustment start signal 217 is inputted, the calculating section 216' automatically adjusts the offset level 207' to an optimal level according to minimum value data 214. The adjustment is carried out in synchronism with the vertical synchronization signal 1. Also in this embodiment, the start signal 217 is a pulse signal which becomes "1" when the automatic offset level adjustment is started. The configuration and operation of the calculating section 216' will be described later in more detail.

The gain level calculating section 218' creates a gain level 208' to adjust the gain in the A/D converting section 10. The calculating section 218' initially outputs a certain initial value for the gain level 208'. However, when a gain adjustment start signal 219 is inputted, the calculating section 218' automatically adjusts the gain level 208' to an optimal level according to maximum value data 215. The adjustment is conducted in synchronism with the vertical synchronization signal 1. Also in this embodiment, the start signal 219 is a pulse signal which becomes "1" when the adjustment is started. The configuration and operation of the calculating section 218' will be described later in more detail.

The display on the LC panel 33 by the A/D converting section 10, LC controller 20, gradation voltage venerating section 24, X-driver 26, and Y-driver 28 is similar to that of the third embodiment.

The gain and offset in the A/D conversion by the A/D converting section 10 are required to be adjusted according to analog display data 6 inputted thereto. Therefore, in this embodiment, the minimum value of digital display data 11 is kept in the minimum value storing section 212. Under the condition, the calculating section 216' adjusts the offset level 207' according to the minimum value.

In addition, the maximum value of digital display data 11 is kept in the maximum value storing section 212. Under the condition, the calculating section 218' adjusts the gain level 208' according to the maximum value. The converting section 10 adjusts the offset and gain for the A/D conversion according to the offset and gain levels 207' and 208'. Thanks to the provision, the offset and gain are automatically retained.

In this connection, each of the calculating sections 216' and 218' output a certain initial level when the power is turned on. The initial level will be described later. When the offset and gain adjustment start signals 217 and 219 are inputted, the calculating sections 216' and 218' respectively start the automatic adjustment of the offset and gain levels 207' and 208', respectively. The signals 217 and 219 may be arbitrarily inputted or may be inputted each time the apparatus is initiated.

Incidentally, it is also possible to use either one of the combinations including a combination of the minimum value storing section 212 and offset calculating section 216' and a combination of the maximum value storing section 213 and gain calculating section 218'.

Since the main aspect resides in the automatic offset and gain adjustment in this embodiment, description will be given primarily of the portion thereof related to the aspect.

The automatic offset and gain adjustment is closely related to the specific configuration and operation of the A/D converting section 10. The specific configuration and operation of the A/D converting section 10 are almost the same as those of the third embodiment.

Next, description will be given of the automatic offset level adjustment in the embodiment.

Figure 29:
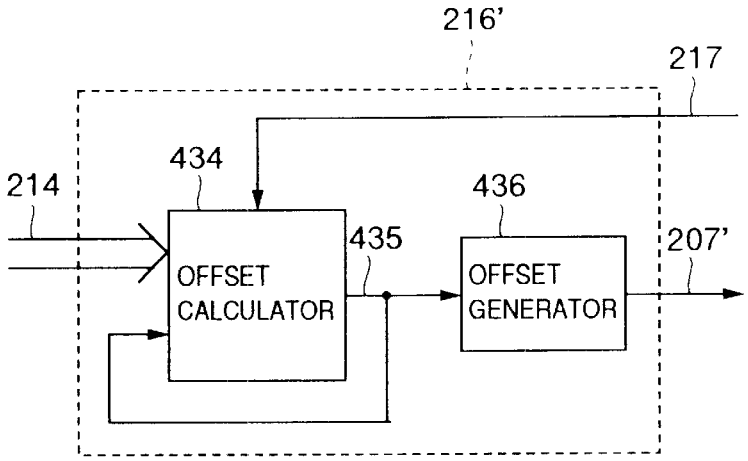
FIG. 29 is a block diagram showing an example of constitution of an automatic offset calculating section of FIG. 28.

First, the configuration of the offset level calculating section 216' will be described with reference to FIG. 29.

The calculating section 216' includes an offset calculator 434 and an offset generator 436.

The offset calculator 434 calculates an appropriate offset level according to the minimum value data 214 before and after the offset adjustment in synchronism with the vertical synchronization signal 1 so as to generate a calculation output 435. It is assumed in this embodiment that the data 214 includes 3-bit display data and the offset calculation output 435 is a digital value which is a certain initial value when the power is turned on. Additionally, the number of bits of the output 435 can be arbitrarily set, and the more the number is, the higher the precision is. The offset calculator 434 subtracts the minimum value data 214 from the initial offset value represented by a digital value and then generates the offset calculation output 435 according to the difference resultant from the subtraction. The offset calculator 434 may be configured with hardware or may be implemented by executing a predetermined program by a microcomputer.

The offset generator 436 generates analog data according to the value of the output 435 from the calculator 434 to output the data as the offset level 207. The generator 436 has a function to convert a digital value to an analog value and hence may include an D/A converter or may be realized by digital variable resistors dividing a reference voltage.

Operation of the offset calculating section 216' will be described by referring to FIGS. 30 and 31. In this connection, an item indicated with reference numeral 300 in FIG. 30 is black display analog data as the minimum value data.

Figure 30:
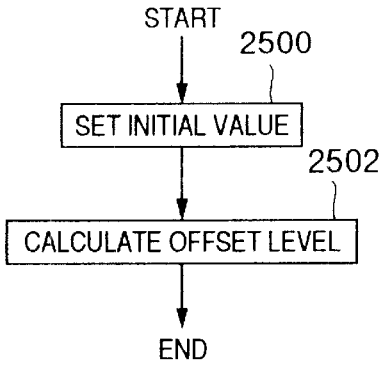
FIG. 30 is a flowchart showing operation of the automatic offset calculating section of FIG. 29.

The offset calculator 434 outputs a certain initial value in step 2500 of FIG. 30 when the power is turned on. It is assumed in this embodiment, the initial value is beforehand set to a larger value to prevent the minimum value data 214 from becoming "0,0,0" (reference is to be made to FIG. 31). In the power-on operation, the initial value of the offset calculator 434 determines that of the offset level 207'.

The offset calculator 434 monitors the start signal 217 to discriminate the automatic adjustment start point. When the start point is detected, the calculator 434 commences the automatic adjustment.

Figure 31:
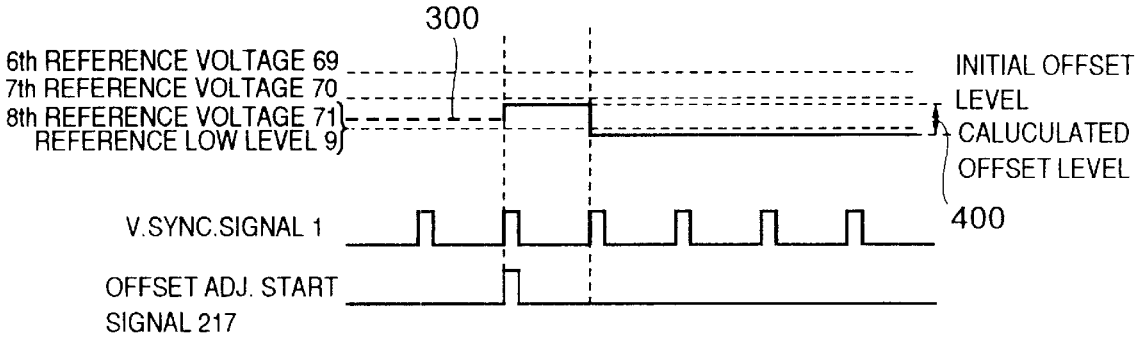
FIG. 31 is a graph showing operation of the automatic offset calculating section of FIG. 29.

During the automatic adjustment, in step 2502 of FIG. 30, the calculator 434 subtracts the minimum value data 214, which is other than "0,0,0" (the width indicated by reference numeral 400 in FIG. 31) from the initial value of the offset level, i.e., calculates an appropriate offset level according to the initial offset value beforehand set to a higher value and then outputs the calculated result as the offset calculation output 435 to the offset level generator 436 (reference is to be made to FIG. 31).

Additionally, in this embodiment, the data 214 is directly subtracted from the initial offset value only once. However, it may also be possible that the data 214 is multiplied by an arbitrary coefficient and/or the process is repeatedly achieved several times such that the difference between the characteristics respectively of the A/D converting section 10 and the offset generator 436 is reflected in the operation result.

Figure 32:
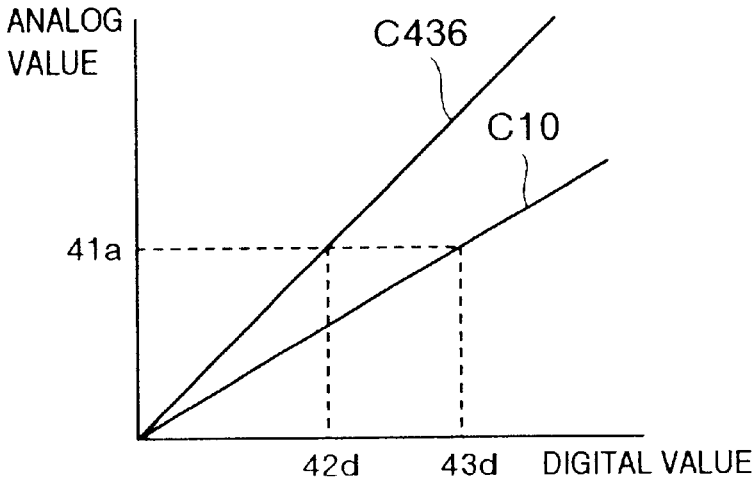
FIG. 32 is a graph showing an example of difference in characteristic related to converting operations between the A/D converter and the offset generating section.

For example, assume that a relationship (conversion characteristic C10) between the digital and analog values of the A/D converting section 10 is different from that (conversion characteristic C436) between the digital and analog values of the offset generator 436 as shown in FIG. 32.

When the offset calculation output 435 from the calculator 434 becomes "43d", the analog offset level, i.e., the output from the offset generator 436 is at a level of "41d" according to characteristic C436. This is the case when it is expected that the analog value of the level of "41a" is converted into a digital value of "42d". However, actually, it may possible that the analog offset level 207' of "41a" is converted by the A/D converting section 10 into a digital value of "43d" according to characteristic C10. In such a case, by repeatedly conducting the calculation (step 2902) several times, the offset level may be gradually set to the optimal value.

Conversely, there may be a case in which the offset level 207' becomes remarkably lower than the optimal value through only one calculation. In this case, by multiplying a coefficient less than one by the data 214, the offset level may be gradually set to the optimal value without causing the event in which the offset level 207' becomes remarkably lower than the optimal value.

As a result, the calculation output 435 and the offset level 207' become associated with appropriate offset levels.

Subsequently, the automatic gain level adjustment of the embodiment will be described.

Figure 33:
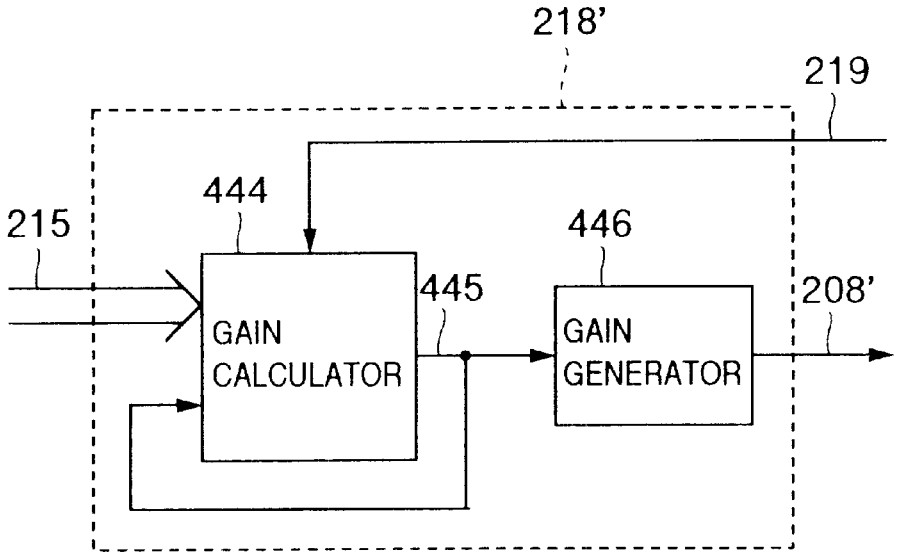
FIG. 33 is a block diagram showing an example of constitution of an automatic gain calculating section of FIG. 28.

First, description will be given of the construction of the gain level calculating section 218' by referring to FIG. 33.

The section 218' includes a gain calculator 444 and a gain level generator 446.

The gain calculator 444 calculates an appropriate gain level according to the maximum value data 215 before and after the gain adjustment in synchronism with the vertical synchronization signal 1 and then outputs the level as the calculation output 445. In this embodiment, it is assumed that the data 215 includes 3-bit display data and the output 445 is a digital value. An initial value is outputted for the output 445 when the power is turned on. Moreover, the number of bits of the output 445 can be arbitrarily set. The greater the number of bits is, the higher the precision is. The gain calculator 444 subtracts the data 215 from the initial value of the gain expressed as a digital value and generates the calculation output 445 according to the difference obtained from the subtraction. The gain calculator 444 may be realized by hardware or may be materialized by executing a predetermined program by a microcomputer.

The gain level generator 446 outputs as the gain level 208 analog data corresponding to the value of the output 445 from the calculator 444. The generator 446 has a function to convert a digital value to an analog value and hence may be constructed with a D/A converter or may be configured with digital variable resistors dividing a reference voltage.

Operation of the gain calculating section 218' will be described with reference to FIGS. 34 and 35. Incidentally, an item denoted by reference numeral 412 in FIG. 35 is analog data for the highest luminance display, the data being treated as the maximum value data.

Figure 34:
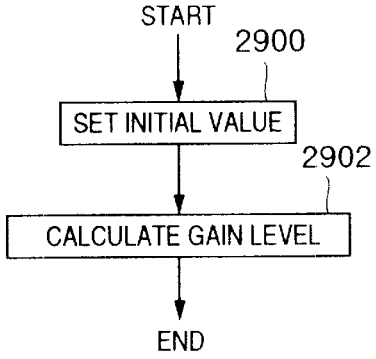
FIG. 34 is a flowchart showing operation of the automatic gain calculating section of FIG. 33.

The gain calculator 444 an initial value in step 2900 of FIG. 34 when the power is turned on. It is assumed in this embodiment, the initial value is beforehand set to a larger value to prevent the maximum value data 215 from becoming "1,1,1" (reference is to be made to FIG. 35). In the power-on operation, the initial value of the gain calculator 444 determines that of the offset level 208'.

The gain calculator 444 monitors the start signal 219 to discriminate the automatic adjustment start point. When the start point is detected, the calculator 444 commences the automatic adjustment.

Figure 35:
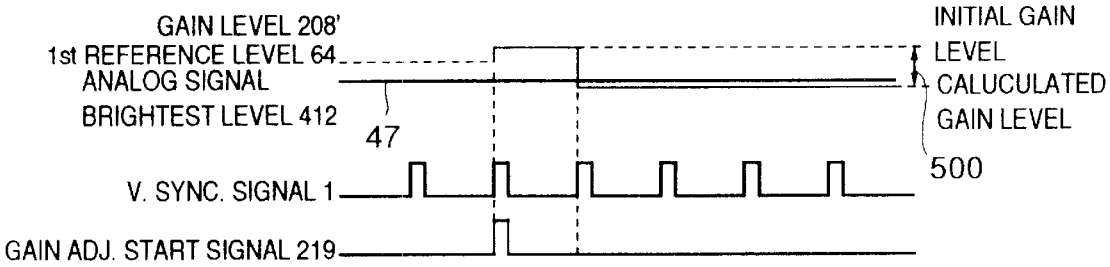
FIG. 35 is a graph showing operation of the automatic gain calculating section of FIG. 33.

During the automatic adjustment, in step 2902 of FIG. 34, the calculator 444 subtracts the maximum value data 215, which is other than "1,1,1" from the initial value of the gain level to obtain a result, i.e., calculates an error (the width indicated by reference numeral 500 in FIG. 35) between an appropriate gain level and the initial gain value beforehand set to a higher value and then outputs the calculated result as the gain calculation output 445 to the gain level generator 446 (reference is to be made to FIG. 35).

Additionally, in this embodiment, the data 215 is directly subtracted from the initial gain value only once. However, it may also be possible, as in the offset calculation, that the data 215 is multiplied by an arbitrary coefficient and/or the process is repeatedly achieved several times such that the difference between the characteristics respectively of the A/D converting section 10 and the gain generator 446 is reflected in the operation result.

As a result, the calculation output 445 and the gain level 208' become associated with appropriate gain levels.

According to the fourth embodiment described above, the offset and gain levels can be automatically adjusted in a shorter period of time when compared with the third embodiment.

Additionally, combining the adjustment of the fourth embodiment with that of the third embodiment, the automatic adjustment can be accomplished in a short period of time with a higher precision.

In the fourth embodiment, since the maximum and minimum values of digital display data after the A/D conversion are read out and then the offset and gain levels are calculated and adjusted according to the values, the optimal offset and gain levels can be automatically attained in a short period of time. In addition, since the maximum and minimum values during one display period are read out, the automatic adjustment can be achieved on the display screen in the status in which the personal computer is ordinarily used.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. An analog interface liquid crystal display apparatus, comprising:

a matrix display panel for being driven by X-directional signal lines and Y-directional signal lines;

an X driver for supplying display data to said X-directional signal lines of said matrix display panel;

a Y driver for sequentially supplying a selection voltage to said Y-directional signal lines of said matrix display panel in synchronism with a horizontal clock signal;

an analog-to-digital (A/D) converter for converting input data in an analog form having a plurality of voltage levels into data in a digital form according to an adjustable reference voltage;

data readout section for reading out said digital data at an arbitrary display position;

a character information generating section for generating character information according to said readout data acquired by said readout section;

an overlay display section for overlaying said character information over said digital data from said converter and displaying thereon an overlay image resultant from the overlaying operation; and a voltage generator for generating gradation voltage signals having a plurality of voltage levels, selecting one of said gradation voltage signals in response to an output from said-A/D converter, and supplying said selected gradation voltage signal to said X-directional signal lines.

2. An apparatus according to claim 1, wherein said matrix display panel can display information in which each pixel includes N bits (N being a positive integer).

3. An apparatus according to claim 1, wherein said voltage generator generates gradation voltage signals having $2^N$ levels.

4. An apparatus according to claim 1, further including a color filter arranged on said matrix display panel.

5. A liquid crystal display apparatus comprising:

a display section;

an A/D converter circuit for converting an input analog display data to a digital display data;

an X driver circuit for supplying to said display section a drive voltage corresponding to said digital display data;

a Y driver circuit for supplying to said display section a selection voltage for scanning said display section;

a selecting circuit for selecting data from said digital display data;

a generator circuit for generating information representative of a data value of said selected data; and a display control circuit for overlaying said information representative of said data value of said selected data upon said digital display data.

* * * * *